US005634306A

United States Patent [19]

Riegelman

[11] Patent Number: 5,634,306

[45] Date of Patent: *Jun. 3, 1997

[54] COMPOSITE FRAMING MEMBER CONSTRUCTION FOR WINDOWS AND DOORS

[76] Inventor: Harry M. Riegelman, 2417 Wimbledon Dr., Arlington, Tex. 76017

[ * ] Notice: The term of this patent shall not extend beyond the expiration date of Pat. No. 5,491,951.

[21] Appl. No.: 633,608

[22] Filed: Apr. 17, 1996

Related U.S. Application Data

[63] Continuation-in-part of Ser. No. 469,333, Jun. 6, 1995, which is a continuation of Ser. No. 203,712, Feb. 28, 1994, Pat. No. 5,491,951, which is a continuation of Ser. No. 788,632, Nov. 6, 1991, abandoned.

[51] Int. Cl.[6] ..... E04C 1/00

[52] U.S. Cl. ..... 52/309.16; 50/656.1; 50/656.2; 50/730.1

[58] Field of Search ..... 52/309.15, 309.16, 52/475, 656.1, 656.2, 730.1, 731.1, 731.2, 732.1, 727, 780, 789; 49/DIG. 1, DIG. 2

[56] References Cited

U.S. PATENT DOCUMENTS

| | | | |
|---|---|---|---|
| 2,581,532 | 1/1952 | Hem | 280/11.13 |
| 3,470,598 | 10/1969 | Berthelsen | 52/309.16 |
| 3,703,063 | 11/1972 | Budich et al. | 52/727 |
| 3,760,544 | 9/1973 | Hawes et al. | 52/468 |
| 3,767,504 | 10/1973 | Singleton | 156/268 |
| 3,964,231 | 6/1976 | Budich et al. | 52/727 |
| 4,130,976 | 12/1978 | Kesseler et al. | 52/656 |
| 4,234,638 | 11/1980 | Yamazoe et al. | 428/133 |
| 4,271,634 | 6/1981 | Andrzejewski | 49/491 |
| 4,341,831 | 7/1982 | Kleiss | 428/188 |
| 4,492,063 | 1/1985 | Schock et al. | 52/309.7 |
| 4,569,154 | 2/1986 | Bayer | 49/504 |
| 4,640,054 | 2/1987 | Breimeier et al. | 49/504 |
| 4,689,933 | 9/1987 | Biro | 52/656 |
| 4,715,153 | 12/1987 | Rohrman | 52/213 |
| 4,776,556 | 10/1988 | Dingler | 249/53 R |
| 4,974,366 | 12/1990 | Tizzoni | 49/504 |
| 4,977,722 | 12/1990 | Taylor | 52/731 |

OTHER PUBLICATIONS

The Design Engineers Guide to Polymer/Metal Composites, Nov. 1986 by Kingston–Warren Co. Newfields, NH 03856.

*Primary Examiner*—Carl D. Friedman
*Assistant Examiner*—Beth Aubrey
*Attorney, Agent, or Firm*—Robert A. Seemann

[57] ABSTRACT

A unitary composite frame member of two or more structural elements. A first and a second of the elements each contributes strength to the member. The second element, a plastic, encloses the first element on essentially all surfaces along the length of the first element, and is molded to itself through recesses of openings in an edge of the first element. The first element is discontinuous in that it is two walls attached lengthwise, and a third wall parallel to them and separate from them. In one embodiment, the third wall and one of the two walls intersect laterally.

34 Claims, 22 Drawing Sheets

COMPOSITE FRAMING MEMBER CONSTRUCTION FOR WINDOWS AND DOORS

This application is a continuation-in-part of application Ser. No. 08/469,333 filed Jun. 6, 1995, which is a continuation of Ser. No. 08/203,712, filed Feb. 28, 1994 now U.S. Pat. No. 5,491,951, which is a continuation of Ser. No. 07/788,632, filed Nov. 6, 1991 now abandoned.

BACKGROUND OF THE INVENTION

1. Field of the Invention

The present invention relates in general to composite framing for building closures, more specifically to framing construction of low thermal transmittance, high strength, and low cost.

2. Description of the Prior Art

Most present day framing members for windows and doors are fabricated from finite lengths of a single material, mainly extruded aluminum, extruded plastic, or wood millwork.

Extruded aluminum offers stiffness and strength, low cost and low maintenance, but has high thermal conductivity. Extruded plastic offers low thermal conductivity, low maintenance and moderate cost, but does not have the stiffness and strength of aluminum. Wood millwork offers low thermal conductivity and reasonable structural qualities, but is higher in cost and requires considerable maintenance.

Preferably a framing member should be a composite of two or more materials, for example, metal and plastic, integrating the best characteristics from each material.

Framing construction art is replete with composite element designs incorporating metals and plastics.

Budich et al. in U.S. Pat. No. 3,703,063, patented Nov. 21, 1972, describes a profile element for windows or doors, comprising a hollow closed metal section surrounded by a shell of plastic for resistance to corrosion and for heat insulation.

He teaches that art prior to his invention includes a great variety of designs having a common disadvantage. It is that the number of basic profiles required for window and door facade assembly is relatively large and that numerous auxiliary profiles are necessary for combining these basic profiles into a flawless, tight connection to the structural component.

The Budich profile overcomes this by providing a plurality of projections of the plastic shell with each projection being for a different application such as a saw-tooth projection for contact with glazing, anchoring means for securing the metal portion to a fixed structure in the form of connecting projections of first and second legs extending in parallel relationship with transverse end portions directed toward each other, and an abutment projection of special shape, for attachment to another Budich profile, so that the profile member has a generally more universally adaptable configuration.

Depending upon their shapes, the projections may be manufactured integrally with the plastic shell, or independently thereof, in which the latter case they are joined to the shell subsequently, for example, by cementing or welding.

U.S. Pat. No. 4,271,634 patented Jun. 9, 1981 by H. Andrzejewski, discloses a metal carrier for channel-shaped sealing, trimming or finishing strip for a channel-shaped window glass guide such as used in automobile window or door openings which resists and limits stretching.

It comprises a series of U-shaped metal elements arranged in side-by-side and spaced apart relationship so as to define a channel.

The elements are connected to one another alternately in series by only a link between the apex of the U, or by a pair of links between the legs, one link being on each side of the U.

Each of the legs connected by a link, further includes an extension adjacent to its distal end. The extension terminates in an abutment face that is adjacent to the abutment face of the corresponding connected leg.

The carrier is covered by flexible plastic in which are imbedded the elements, legs, links and abutments. Manufacture is suggested to be by cutting slots in a metal blank by stamping or pressing, then rolling the blank longitudinally in to a U-shape, and after manufacturing the blank, feed the blank into a cross-head extruder so as to cover it with the extruded plastic or rubber.

A tubular seal on one side of the U, along the length of the carrier may be included integrally with the covering, or may be secured to it by some means. In either case it need not be of the same hardness as the carrier covering.

The alternate links permit the carrier to flex during installation, while the abutting extensions prevent or limit stretching of the strip so that it will resile quickly at the time of installation of the strip to a body, for a better and more secure fit.

U.S. Pat. No. 4,569,154 patented by M. Bayer on Feb. 11, 1986, discloses a metal and plastic composite type construction for window framing which, instead of plastic coating over metal, consists of an inside facing plastic extrusion member joined by interconnecting interlocking barbs, darts or arrows to a generally parallel outside facing metal extrusion member. One member is more rigid than the one to which it is joined, and one member has lower thermal conductivity than the one to which it is joined. The shape of the barbs is important to a success of providing a positive lock function for securing the parts together to provide thermal insulation coupled with window strength.

U.S. Pat. No. 4,640,054, patented Feb. 3, 1987 by Breimeier et al., describes a frame for windows or doors which consists of two plastic covered, hollow metal sections, joined by the plastic of their coverings. One section is exposed to the outside environment, the other to the inside environment.

This is different from the art in which a single, plastic covered hollow metal section is exposed to the inside environment on one side, and the outside environment on the other side.

In Breimer's invention, the plastic that is covering and joining the two sections provides thermal insulation. The arrangement permits the two thermally separated hollow aluminum sections to assume different temperatures whereby their elongations and shrinkages have less affect on the neighboring plastic than other designs in the art.

U.S. Pat. No. 4,715,153, patented Dec. 29, 1987 by H. Rohrman, discloses a universal building panel structural frame member which may be used as a head member, side jamb member, sill member, vertical mullion, and horizontal transom member, to form those structures without a need for members of different design, and brackets, plates and bolts to join them.

The invention comprises a unitary elongate roll-formed element that can be cut to length to provide structural members for the above purposes. The element is J-shaped in cross-section, having a flat elongate intermediate plate member, a head on one side of the plate member having portions laterally extending outwardly in opposite directions from the plate member, and a foot member on the opposite side of the plate member laterally extending therefrom. A pair of opposed elongate lips also extend from the plate member.

A preferred embodiment comprises a steel J-shaped member coated with an elastomeric or other thermally insulating coating. The steel adds structural strength without adding bulk. The coating provides thermal insulation without reducing the structural strength of the curtain wall members.

U.S. Pat. No. 4,974,366, patented Dec. 4, 1990 by S. Tizzoni, describes a frame construction for a door opening. The frame includes a reinforced, insulated jamb member which comprises an elongated metal U-shaped channel with one leg being toward the inside environment, and the other leg being toward the outside environment.

The elongated open front end of the channel is closed by a vinyl cover thereby defining with the channel an elongated cavity. An insulating foam is injected into the cavity. After the foam hardens into a rigid and strong insulating core, the back of the U-shaped channel is sawed through lengthwise to establish a metal free insulating space between the legs of the channel.

The rigidity of the jamb is assured by the hardened insulating material between the legs. Retention of the insulating material by the legs is aided by surface grip characteristic of the Isolok TM polyurethane based rigid foam and by flanges along the length of the legs which project into the cavity.

The insulating foam is dense enough to hold hinge screws driven through the vinyl cover and into the foam, and rigid enough to withstand flexion forces exerted by weight of a door on the screws.

SUMMARY OF THE INVENTION

It is one object of the invention to provide a unitary composite frame member, of two or more materials, which has high structural strength, low thermal transmittance and low cost.

It is another object of the invention to provide an inexpensive unitary composite framing member of high structural strength and low thermal transmittance, which can be constructed by forming a first material, and covering it by a second material.

It is another object of the invention to provide the above unitary composite member in which the first material is of high strength, and the second material is of moderate strength but significantly lower thermal conductivity than the first material.

It is still another object to provide the above unitary composite member in which the second material is mechanically bonded to the first material to obtain maximum combined strength and to resist forces of differential thermal expansion.

It is still another object to provide the above unitary composite member in which the first material has portions removed in such a manner as to substantially restrict thermal flow through the material but not significantly reduce its structural strength.

In accordance with the invention a frame member of predetermined shape includes a first element that is structural in nature for contributing structural strength to the member. It is substantially non-hollow in transverse cross section.

A second inflexible element of the frame member comprises the shape of the frame member. It encloses the first element along its length in a composite, unitary molding.

If desired, the second element may cover the first element, to the extent that the shape of the frame member is expressed by the second element.

The first element may be made from a material which has high thermal conductivity.

Preferably, the first element is made with metal, and the second element is made with plastic, each of the elements being strong enough to retain its shape without aid from the other element.

The type of plastic and thickness of the second element is chosen for the second element to contribute to the strength of the member, and to be of significantly lower thermal conductivity than the first element.

Preferably, the second element contributes at least 10% of the total structural strength of the entire member and has a thermal conductivity not exceeding 5%, and preferably not exceeding 1% of that of the first element.

The two elements are molded together with a mechanical grip that maximizes the combined strength of the two elements and resists differential expansion, by molding the second element in a plurality of similarly shaped openings in the first element thereby restricting slippage and detrimental effects from difference in thermal expansion between the two elements. The shapes of the openings include rectangular, angular, circular and mesh.

A method for making the composite frame member of predetermined shape includes forming a metal strip into a U-channel, passing the U-channel through a plastic extruder for coating the steel strip with plastic in a thickness that increases the strength of the member, and sawing through the coating and U-channel between the legs of the U-channel, for substantially reducing thermal transmittance of the frame.

BRIEF DESCRIPTION OF THE DRAWINGS

In order that the invention be more fully comprehended, it will now be described, by way of example, with reference to the accompanying drawings, in which:

FIG. 1 is an all aluminum frame according to prior art.

FIG. 2 is a thermally broken "TB aluminum", aluminum frame according to prior art.

FIG. 3 is an all vinyl frame according to prior art.

FIG. 4 is an all wood frame according to prior art.

FIGS. 5–11 are composite constructions according to the present invention. These examples are made from vinyl and steel in various configurations for comparison of their relative strength, cost and thermal transmittance values.

FIG. 12 is a perspective view of a high bond, high strength composite frame of low thermal transmittance and cost.

FIG. 13 is a perspective view of another high bond composite frame of low thermal transmittance and cost.

FIG. 14 is a perspective view of a high bond, high strength, composite frame of low thermal transmittance and cost.

FIG. 15 is a perspective view of a high bond, high strength frame of low thermal transmittance and cost.

FIG. 16 is a perspective view of a high bond, high strength frame of low thermal transmittance and cost.

FIG. 17 is a perspective view of manufacturing stages of a high bond, high strength frame of low thermal transmittance and cost.

FIG. 18 is a perspective view of a box-beam composite construction.

FIG. 19 is a perspective view of an H-beam composite construction.

FIGS. 20 and 21 are sliding glass door assemblies incorporating the variations of the frames shown in FIGS. 5–19.

DESCRIPTION OF THE PREFERRED EMBODIMENTS

Figure 1:
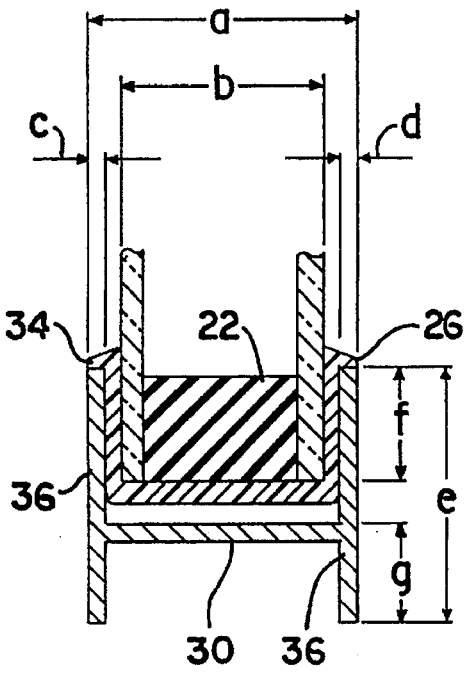
FIG. 1 PRIOR ART
FIGS. 1–11 are cross section diagrammatic views of window frames for comparison of strength, cost and thermal transmittance.
Figure 2:
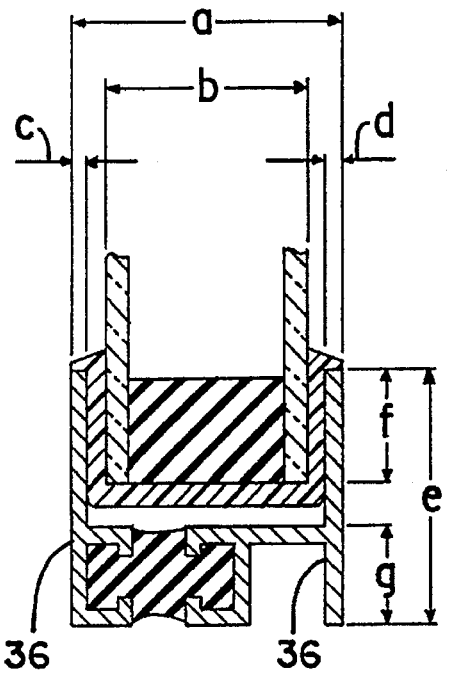
FIG. 2 PRIOR ART

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation. For convenience of the reader in understanding the invention, copending application Ser. No. 08/203,712, now U.S. Pat. No. 5,491,951 is incorporated herein by reference.

A frame constructed according to the present invention includes at least two structurally strong materials, one having substantially lower thermal conductivity properties.

Relative strength, cost and thermal transmittance values for FIGS. 1–11 are provided in chart A. These figures typify constructions for windows and sliding glass doors. Shown in cross section, they include, for comparison, an all aluminum frame, FIG. 1, a thermally broken "TB" aluminum frame, FIG. 2, an all plastic frame with hollow legs and base, FIG. 3, and a solid wood frame, FIG. 4.

In the figures, window pane 22 held by locating strip 26 rests in channel 30, supported by shoulders 34 on forward channel legs 36.

Figure 5:
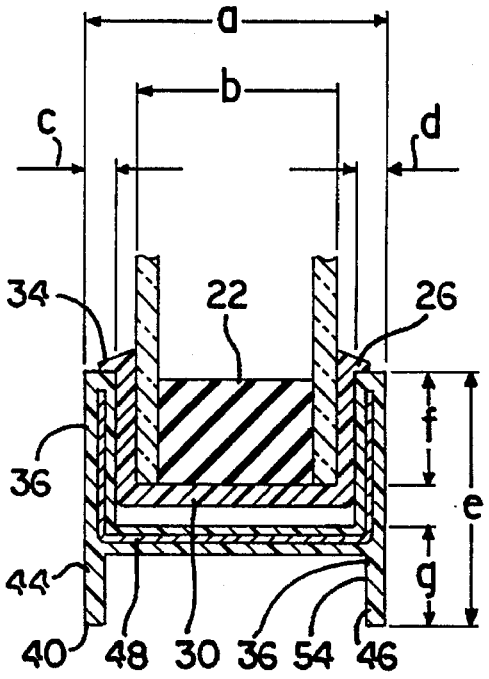

Referring to FIG. 5, frame 40 which is constructed according to the invention includes structurally strong plastic 46 which covers structural steel U-channel element 48 to a thickness that insulates and adds strength to the frame. This is different from the common relatively soft or thin plastic coatings or laminations provided for insulation and corrosion resistance.

Preferably the plastic is rigid and capable of retaining its shape as recognizable at rest without aid from the metal.

Rearward depending legs 54 are made of the same structurally strong plastic. They resist twisting and bending forces on the frame without substantially adding weight or thermally receptive surface area.

Preferably, the relationship of plastic to metal in a unitary construction according to the invention is such that the plastic provides at least 10% of the structural strength of the entire item and the thermal conductivity of the plastic does not exceed 1% of that of the metal.

For example, in a strength test in which a portion that would contain metal is bent without the metal contained, the portion will provide at least 10% of the strength that the portion would provide as the composite portion of the unitary construction.

Preferably the ratio of the composite elements in type and arrangement is selected so that thermal transmittance of the total composite shape does not exceed 70% of the conductivity of the metal element.

Figure 6:
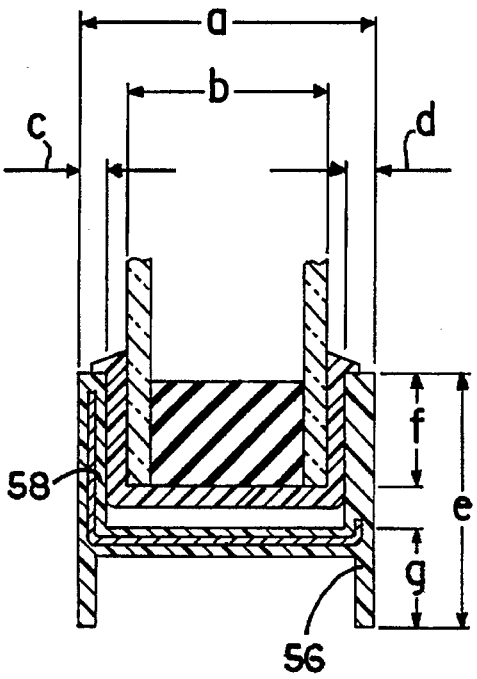

FIG. 6 shows a frame 56 which is similar to FIG. 5 except that one leg of the steel U-channel element 58 is shorter than the other.

Figure 7:
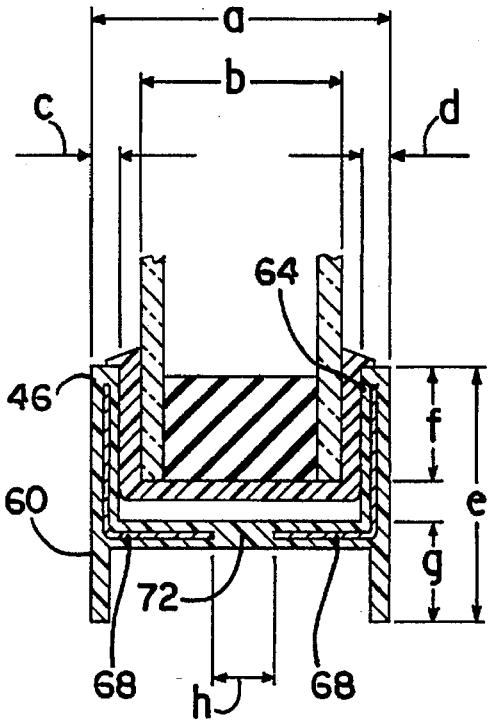

In FIG. 7, frame 60 includes U-channel 64 comprising parallel L-shaped structural steel strips 68 and structural plastic 46.

Gap 72 lowers the thermal transmittance of the frame. Complete encapsulation of strips 68 in structural plastic further contributes to lowering the thermal transmittance and adds strength to the frame.

Frame 60 is preferably made by continuous extrusion of the plastic structural element over the strips.

Sources for making frame 60 to specifications in accordance with the present invention by adjustment of the source's processes are available. For example, Kingston-Warren Company, Composite Technology Division 11/1986 bulletin THE DESIGN ENGINEER'S GUIDE TO POLYMER/METAL COMPOSITES offers a service of manufacturing elements constructed of plastic over metal by non-adhesive bonding.

In the process, as it is described, progressive roller dies shape a continuous metal strip. The polymer (rubber, synthetic, or blend) is extruded onto the passing metal. It is bonded and cured in the same production line, which might also include operations such as cutting, notching, punching, or coating. The product leaves the line in net or near-net shape. Two or more polymer sections may be permanently joined by cross heading and multiple extrusion lines.

Figure 8:
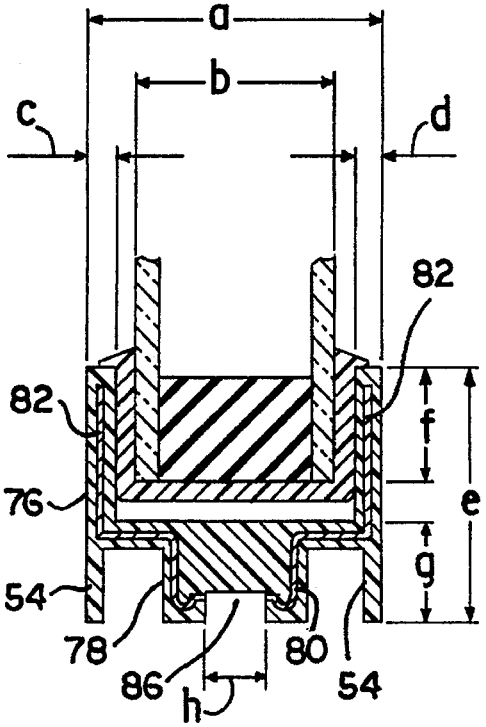

Frame 76, FIG. 8, is stronger than frame 60 and has a lower thermal transmittance.

Rearwardly depending leg 78 of structural plastic, which is wider than rearwardly depending legs 54, and second stage, rearwardly displaced J-shaped portions 80 of first stage steel L-strips 82 increase overall resistance to twist and bend of the frame.

Gap 86 is preferably made by continuous saw cut as or after composite frame 76 leaves the extrusion die.

Figure 9:
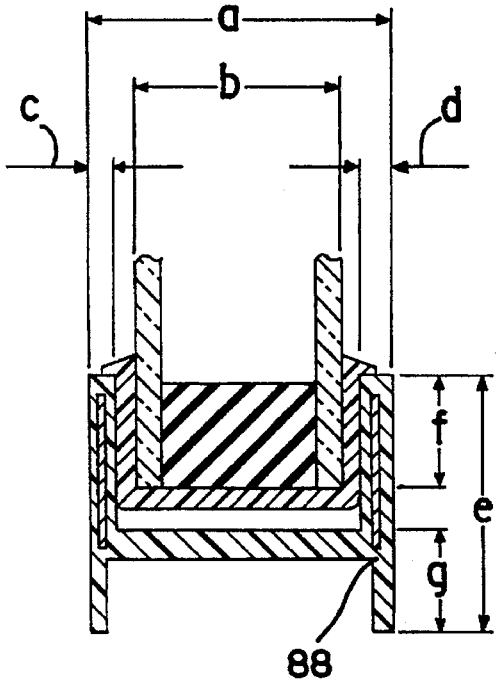

Referring to FIG. 9, frame 88 features a wider gap between metal strips. This provides a lower thermal transmittance for the frame which obtains its strength and stiffness from the plastic, and resistance to bending from the metal.

side of U-channel element 96 fuses with plastic that it meets from the other side of 96.

Figure 11:
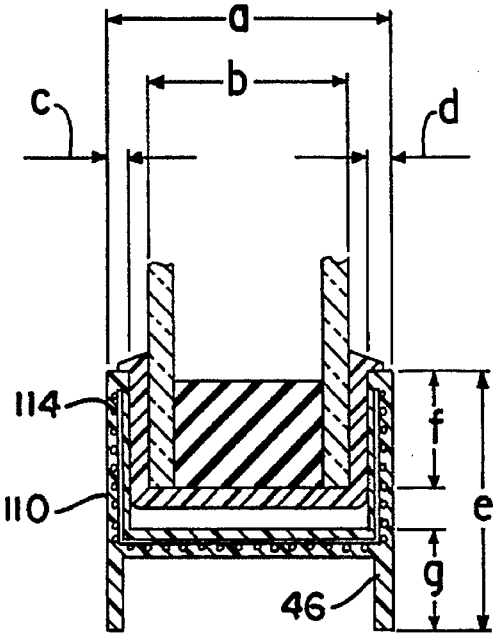

In frame 110, FIG. 11, bond between structural plastic 46 and steel U-channel element 114 in which the plastic passes through the metal element incorporates all of element 114 which is a mesh. In this arrangement the rigidity of frame 110 can be closely controlled to a predetermined specification while reasonable strength and resistance to bending is maintained, with low thermal transmittance and cost.

Figure 13:
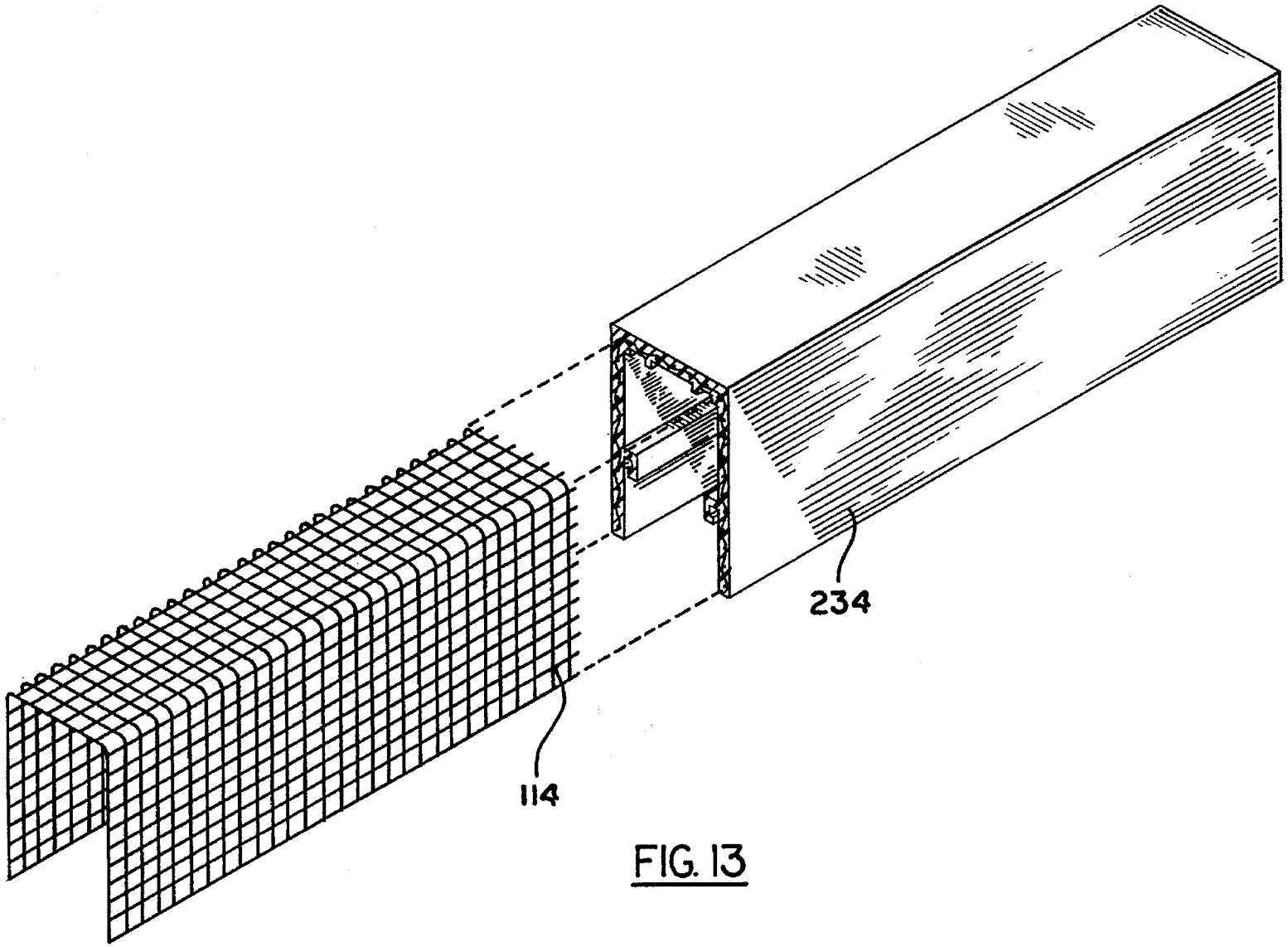

Preferably rigidity and strength is mostly controlled by the plastic, while resistance to bending is controlled by the mesh having a discrete structural shape as may be seen in FIG. 13. This is different from Fiberglas layered buildup construction.

For a lower U value, the mesh is made from stretch-resistant plastic rod, or natural or synthetic fiber.

As with the formed metal elements shown in FIGS. 5–10, the mesh element may be molded with the plastic into a continuous frame component by a plastic extrusion process.

Relative strength, cost and thermal transmittance values for the above designs may be compared in the following chart "A" where, in like dimensional indicators a–g, the magnitude of the reference dimensions are selected for purpose of example, and are not to be construed as limitations upon actual construction.

Figure 3:
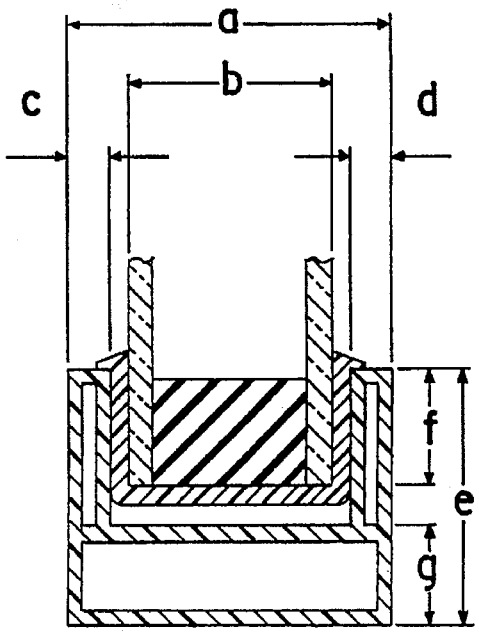
FIG. 3 PRIOR ART
Figure 4:
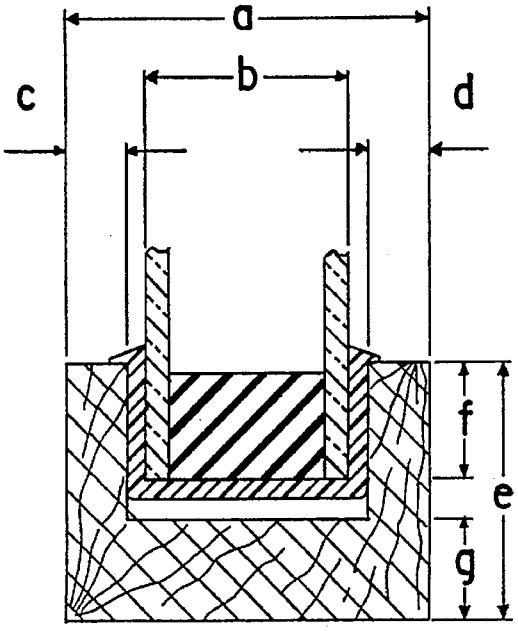
FIG. 4 PRIOR ART

In FIGS. 3 and 5–11 the plastic is vinyl. In FIGS. 5–10, the structural steel is 0.5 millimeters thick. In FIG. 11, the steel is 0.25 millimeters mesh. In FIG. 3, the vinyl is 2 millimeters thick.

As the following chart "A" shows, the present invention provides a frame member of higher strength and lower thermal transmittance at a cost that is often lower than prior art members.

CHART A

| FIGURE NO. | DESCRIPTION | DIMENSIONS IN MILLIMETERS a | b | c | d | e | f | g | h | RELATIVE STRENGTH | RELATIVE COST | RELATIVE THERMAL TRANSMITTANCE |
|---|---|---|---|---|---|---|---|---|---|---|---|---|
| 1 | ALUMINUM | 26.5 | 20.0 | 1.25 | 1.25 | 27.0 | 13.0 | 11.0 | | 100 | 20 | 100 |
| 2 | TB ALUMINUM | 26.5 | 20.0 | 1.25 | 1.25 | 27.0 | 13.0 | 11.0 | 6.0 | 96 | 49 | 68 |
| 3 | VINYL | 36.0 | 20.0 | 6.00 | 6.00 | 27.0 | 13.0 | 11.0 | | 19 | 44 | 49 |
| 4 | WOOD | 36.0 | 20.0 | 6.00 | 6.00 | 27.0 | 13.0 | 11.0 | | 98 | 100 | 46 |
| 5 | COMPOSITE | 29.0 | 20.0 | 2.50 | 2.50 | 27.0 | 13.0 | 11.0 | 6.0 | 99 | 24 | 67 |
| 6 | COMPOSITE | 29.0 | 20.0 | 2.50 | 2.50 | 27.0 | 13.0 | 11.0 | | 56 | 23 | 51 |
| 7 | COMPOSITE | 29.0 | 20.0 | 2.50 | 2.50 | 27.0 | 13.0 | 11.0 | 5.0 | 94 | 24 | 57 |
| 8 | COMPOSITE | 29.0 | 20.0 | 2.50 | 2.50 | 27.0 | 13.0 | 11.0 | | 99 | 36 | 56 |
| 9 | COMPOSITE | 29.0 | 20.0 | 2.50 | 2.50 | 27.0 | 13.0 | 11.0 | 14.0 | 81 | 23 | 52 |
| 10 | COMPOSITE | 29.0 | 20.0 | 2.50 | 2.50 | 27.0 | 13.0 | 11.0 | | 94 | 24 | 62 |
| 11 | COMPOSITE | 29.0 | 20.0 | 2.50 | 2.50 | 27.0 | 13.0 | 11.0 | | 33 | 23 | 60 |

Figure 10:
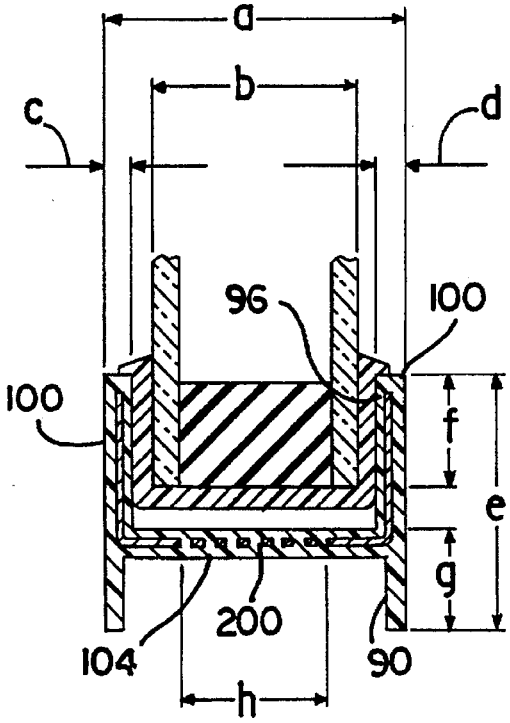

Referring to FIG. 10, frame 90 has greater resistance to twist and bend forces than does frame 60 shown in FIG. 7. This is because steel U-channel element 96 has continuity across strip 104 between forward channel legs 100. Although 80% of the metal is removed in strip 104 to reduce thermal flow between its legs, the remaining 20% is in the form of grid 200 for strength and rigidity. Grid 200 may be seen in FIG. 12.

Figure 12:
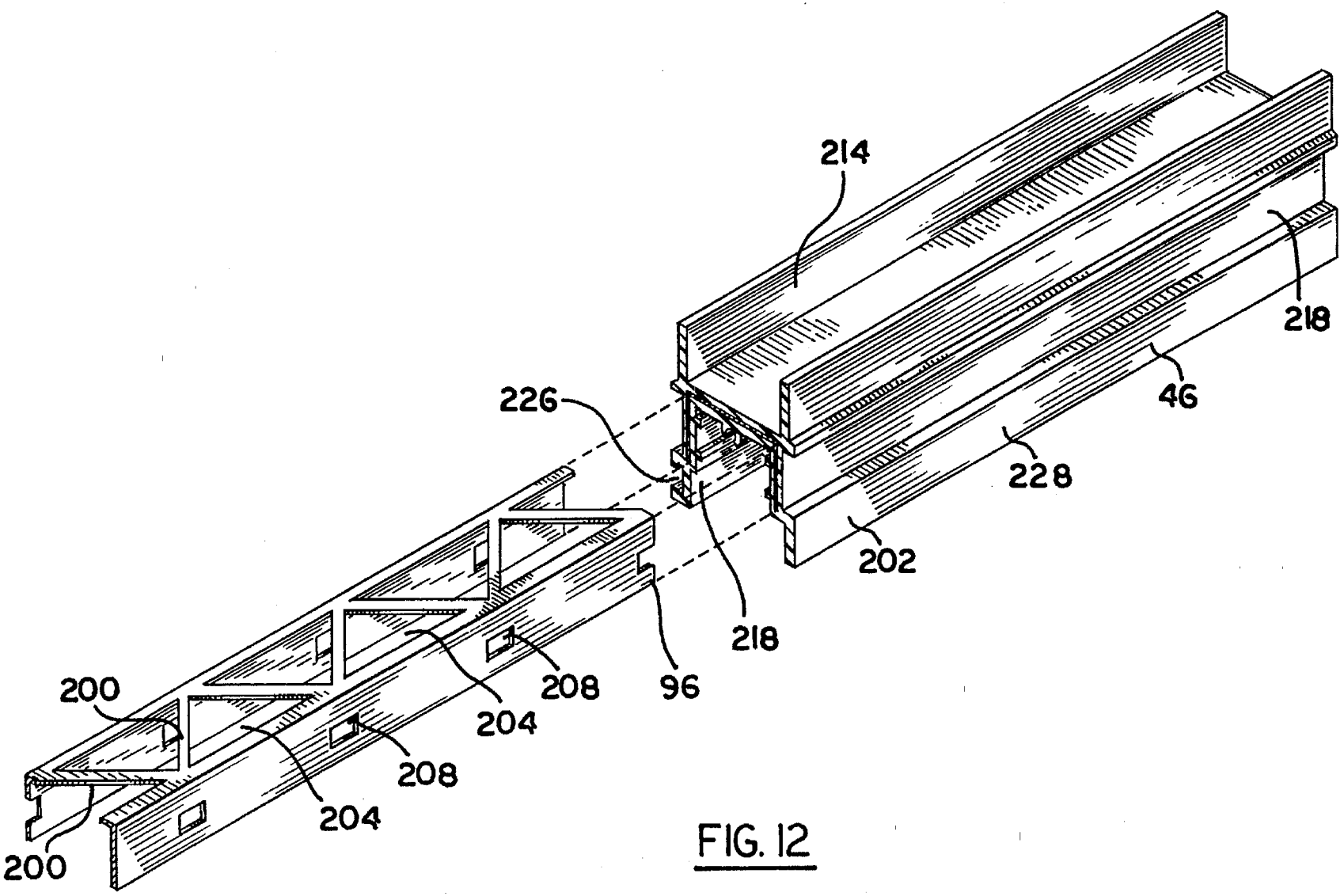
FIGS. 12–21 are further examples of constructions according to the present invention.

Full benefit of the combined strength of structural plastic 46 and metal 96 is obtained by assuring the mechanical bond relationship between the plastic and the metal. Differences in thermal expansion and bending can apply disruptive forces to the bond. This is overcome by passage of the plastic through openings 204 in grid 200 so that it conforms to the cavities therein. Preferably extrusion parameters are set to assure that plastic passing though openings 204 from one FIG. 12 shows frame 202 with grid 200 and openings 204 in the grid for receiving structural plastic 46 as described earlier with respect to FIG. 10. Rectangular openings 208 further contribute to the bond between the plastic and metal.

Rearwardly depending structural plastic legs 214 resist bending of frame 202. Forward channel legs 218 include specialized structural plastic extensions comprising an outward facing, longitudinal slot 226 along one extension, and a longitudinal L-shaped strip 228 along the other extension.

FIG. 13 shows a mesh, steel U-channel 114 as discussed earlier for FIG. 11, and a simple, U-shaped frame 234 with which it is extruded.

Figure 14:
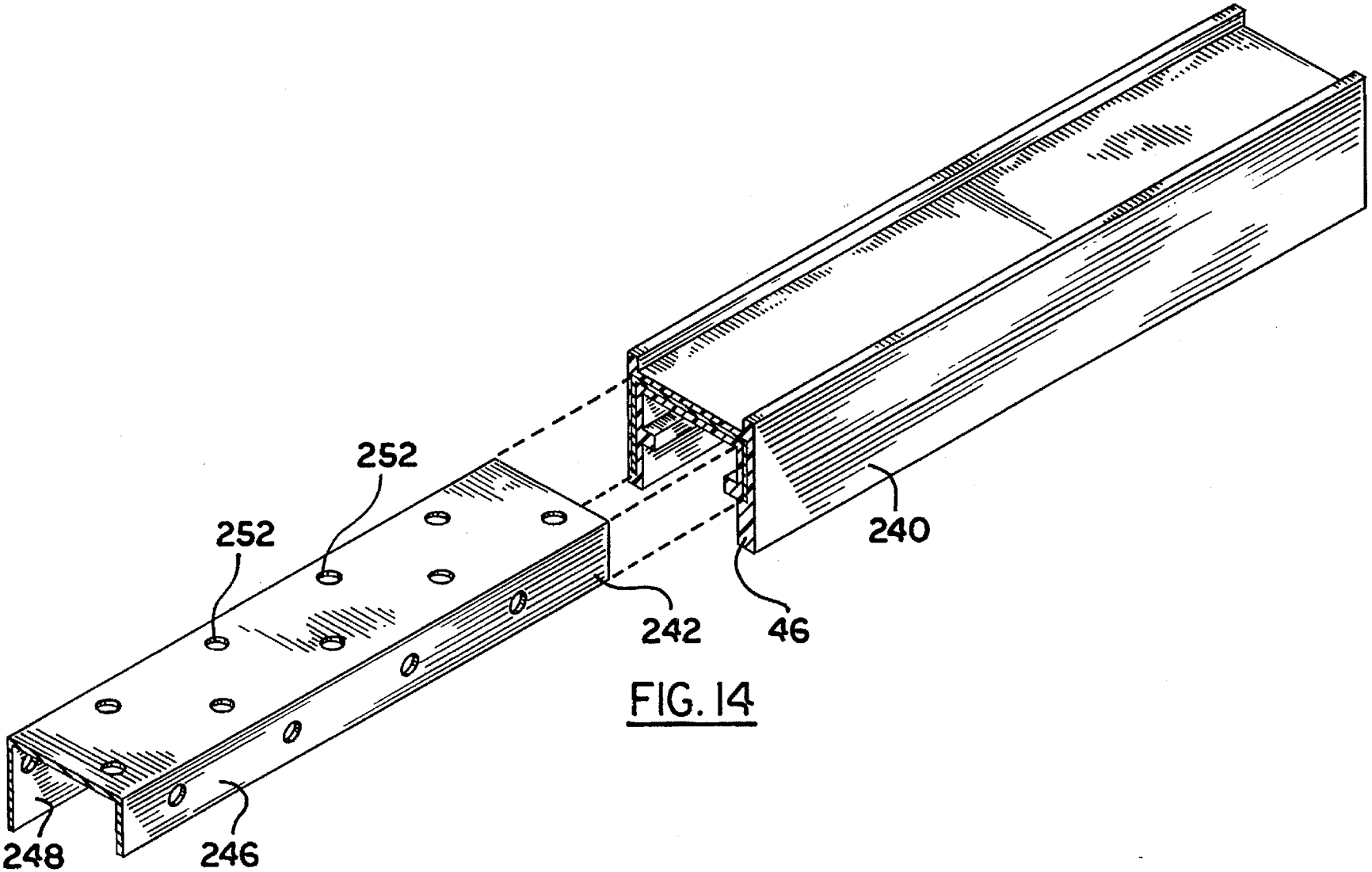

U-shaped frame 240, FIG. 14, includes J-shaped channel element 242, having leg 246 shorter than leg 248. Round openings 252 through element 242 assure a strong frame due to secure bond between structural plastic 46 and element 242.

Figure 15:
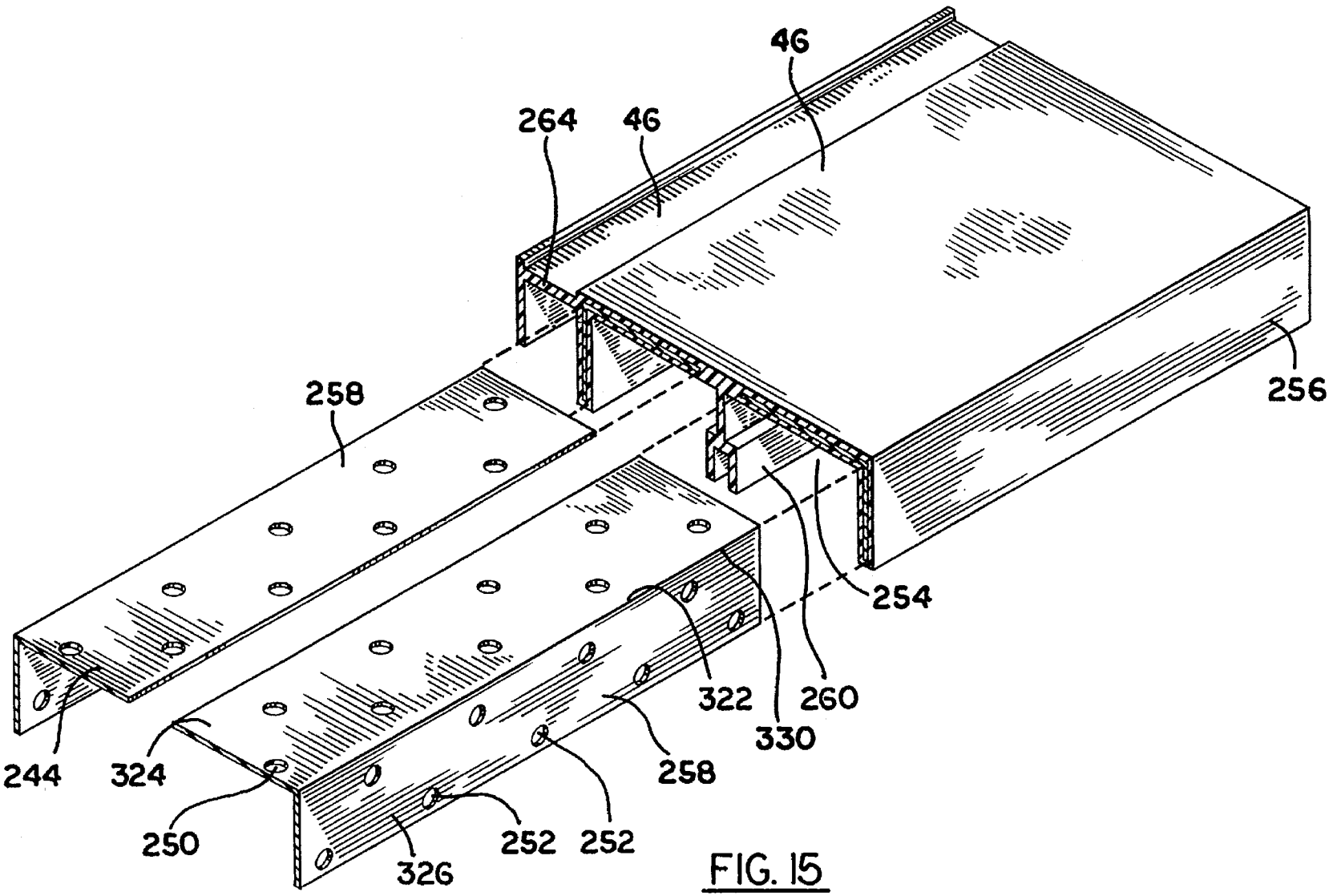

In FIG. 15, frame 256 includes channel 254 which comprises parallel L-shaped structural steel strips as described for FIG. 7, with round openings 252 for structural bond with plastic 46.

Frame 256 is molded in one continuous unitary form which includes channel 254 with plastic channel 260, plastic L strip 264, and L-shaped steel strips 258.

Figure 16:
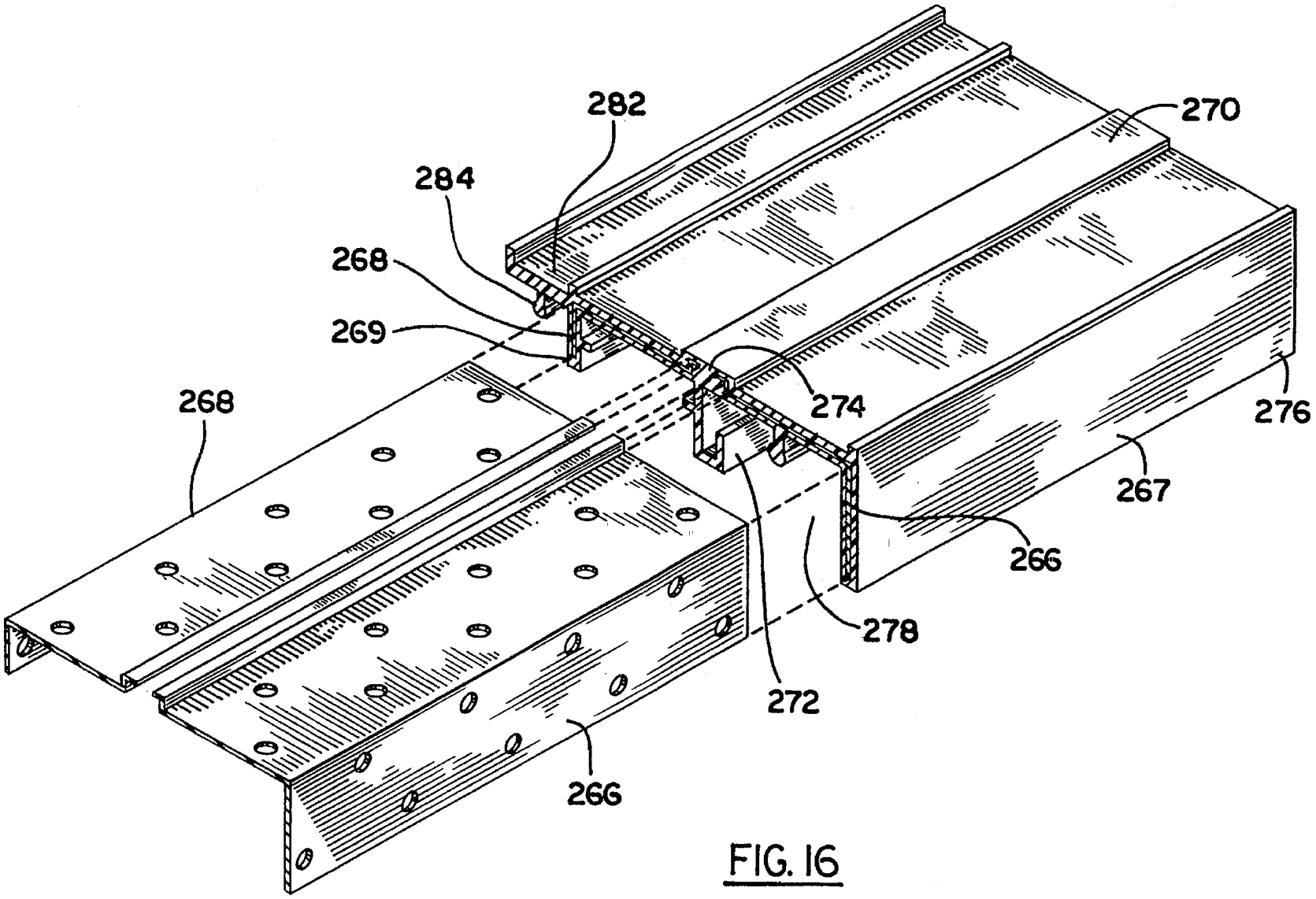

Referring to FIG. 16, the steel L strips 266 and 268 and rearwardly depending leg 270, with gap 274 of frame 276 are similar to the strip 82, leg 78, and gap 86 arrangement shown and described for frame 76 of FIG. 8. J-shaped forward leg 272 is molded within U-channel 278 about the location of gap 274. Strip 282, extending laterally from leg 269, the shorter of the two legs 267 and 269, and containing forward guide rail 284, is also integrally molded with frame 276.

Figure 17:
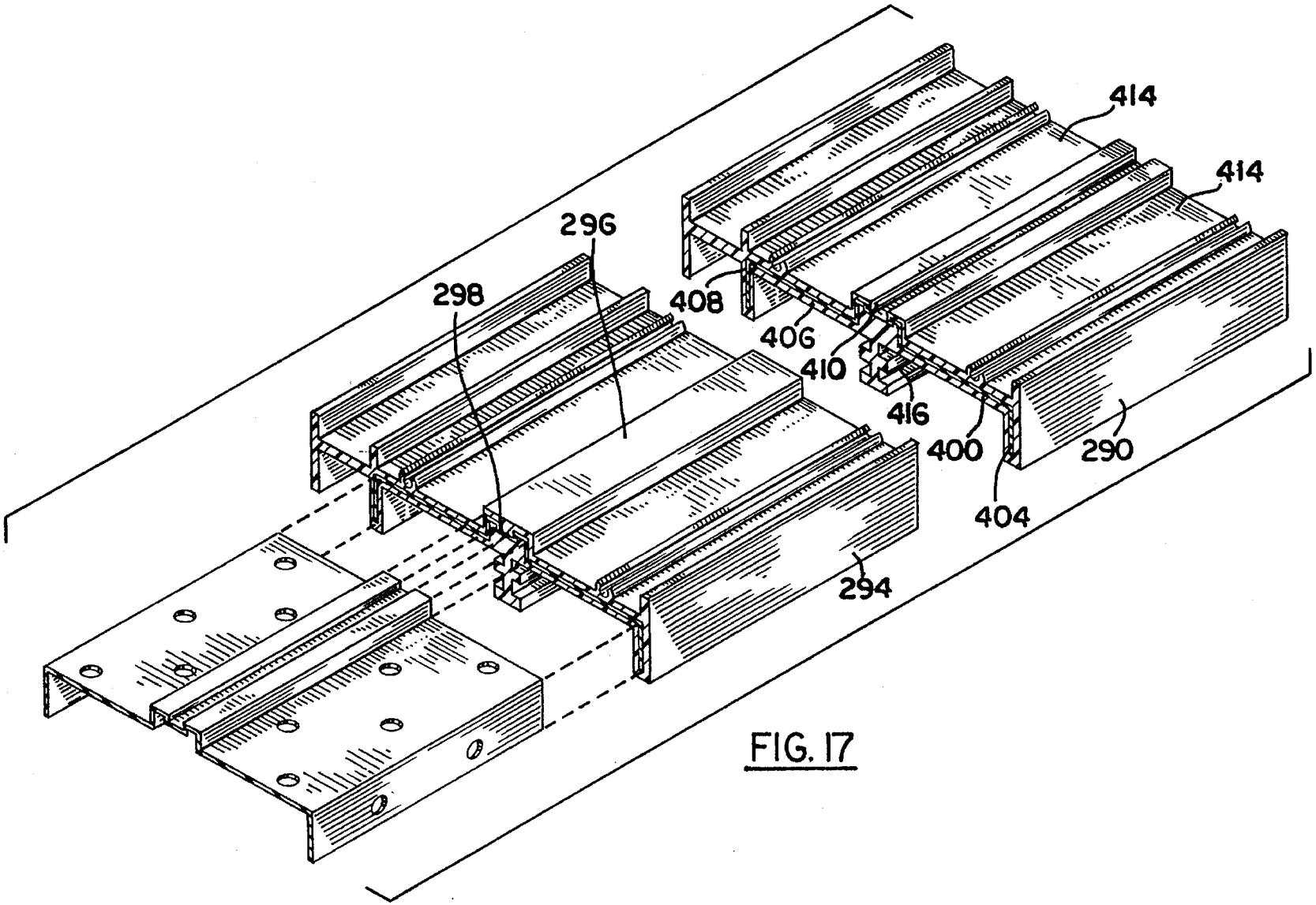

FIG. 17 shows frame 290 made from frame 294 which was extruded as a unitary item, by sawing down through rearwardly depending leg 296 just through steel U-channel element 298, similarly to the way that gap 86 was made in frame 76 shown in FIG. 8.

Figure 18:
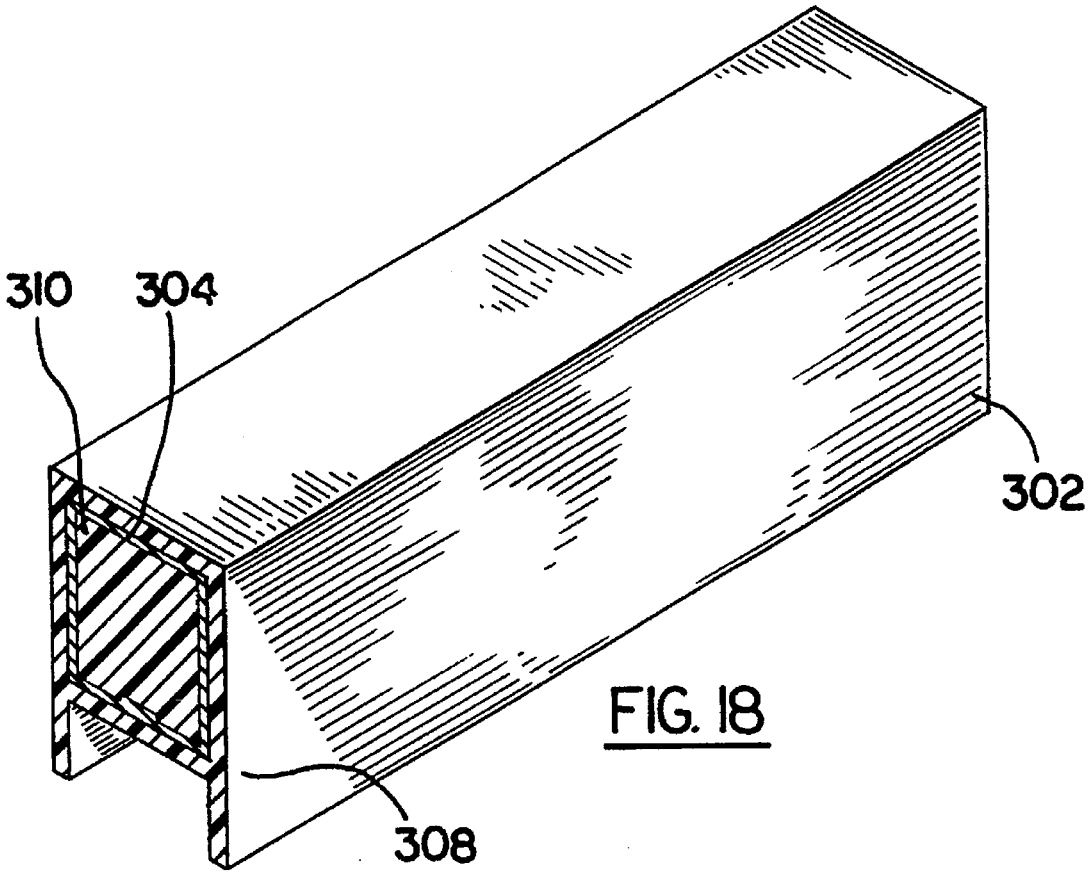

Frame 302, shown in FIG. 18, includes two structural plastics with metal box-beam 304. Plastic 308 provides stiffness and support in a required configuration, while plastic 310 and box beam 304 provide resistance to twist and bending.

Figure 19:
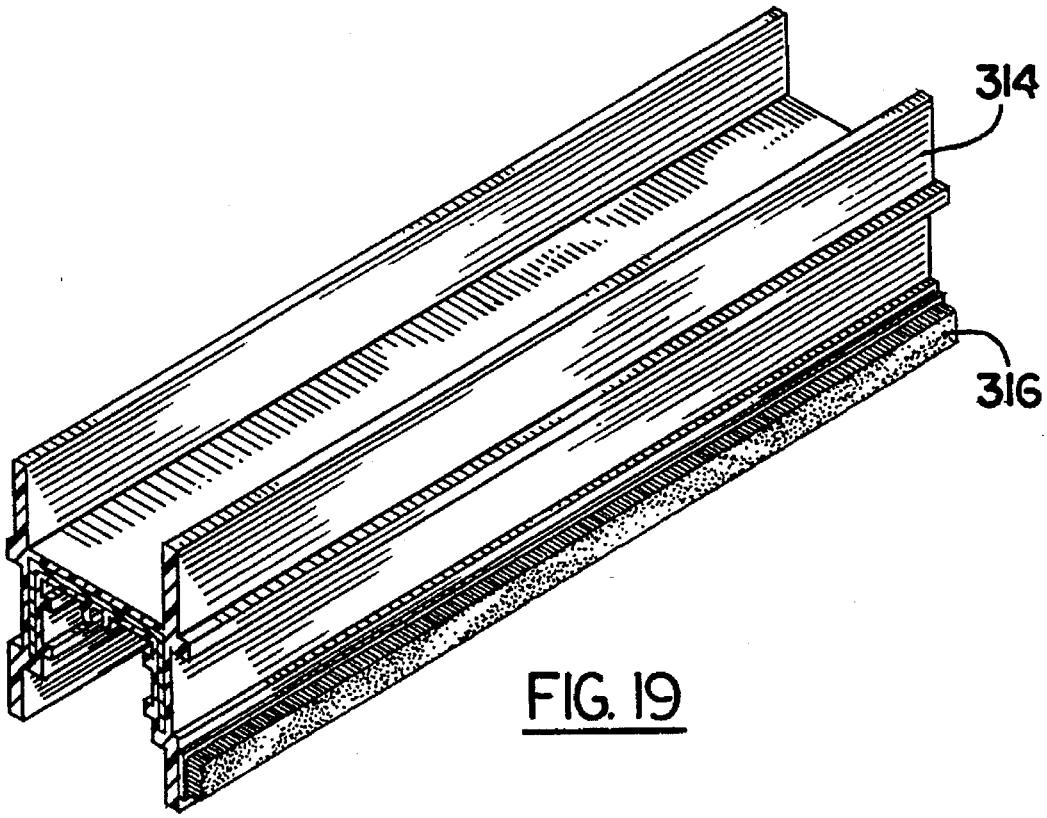

Frame 314, shown in FIG. 19 includes continuously attached weatherseal 316.

Figure 20:
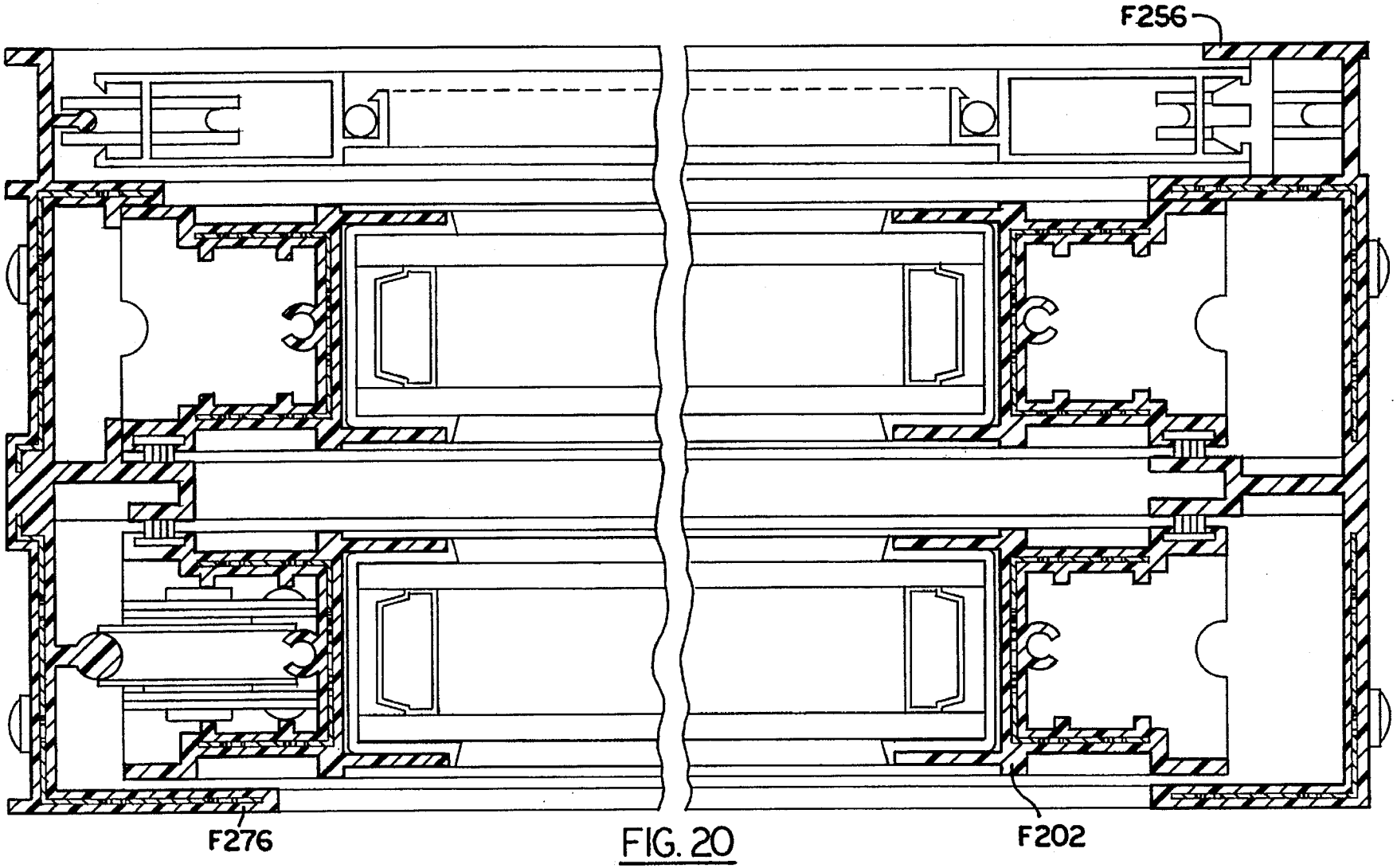
Figure 21:
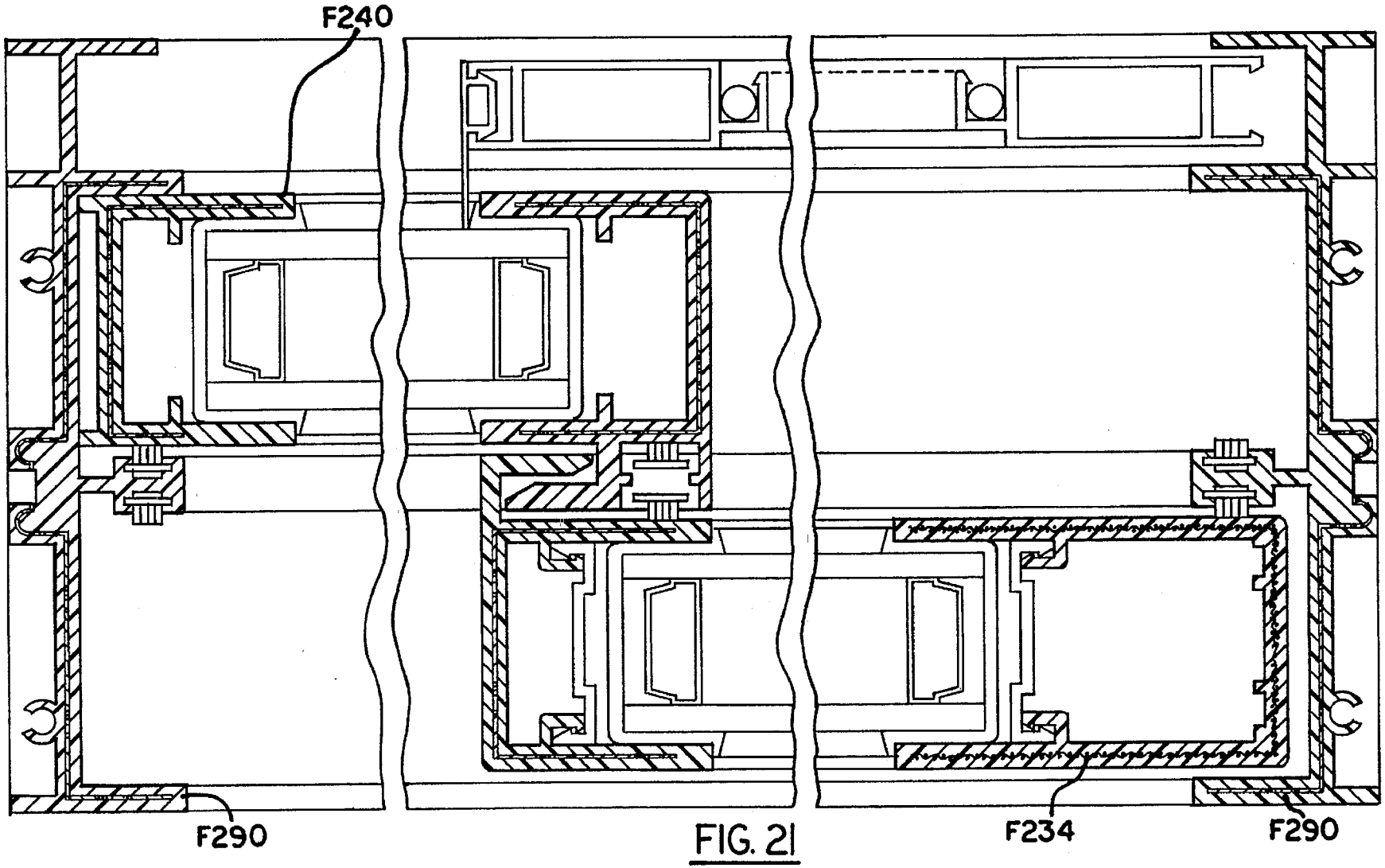

Various applications of the frames shown in FIGS. 5 through 19, and 22 through 42, may be seen in the sliding glass door assembly examples in FIGS. 20 and 21. They are designated by "F" followed by the number of a frame having similar features.

Although examples of sliding glass door framing members are shown, it should be understood that the present invention is applicable to window and other frame assemblies.

The arrangement in the ensuing descriptions of the invention provides improved lateral strength for the structural frame member, while continuing to have the combined thermal and longitudinal strength benefits of the original invention of Ser. No. 07/788,632.

Figure 22:
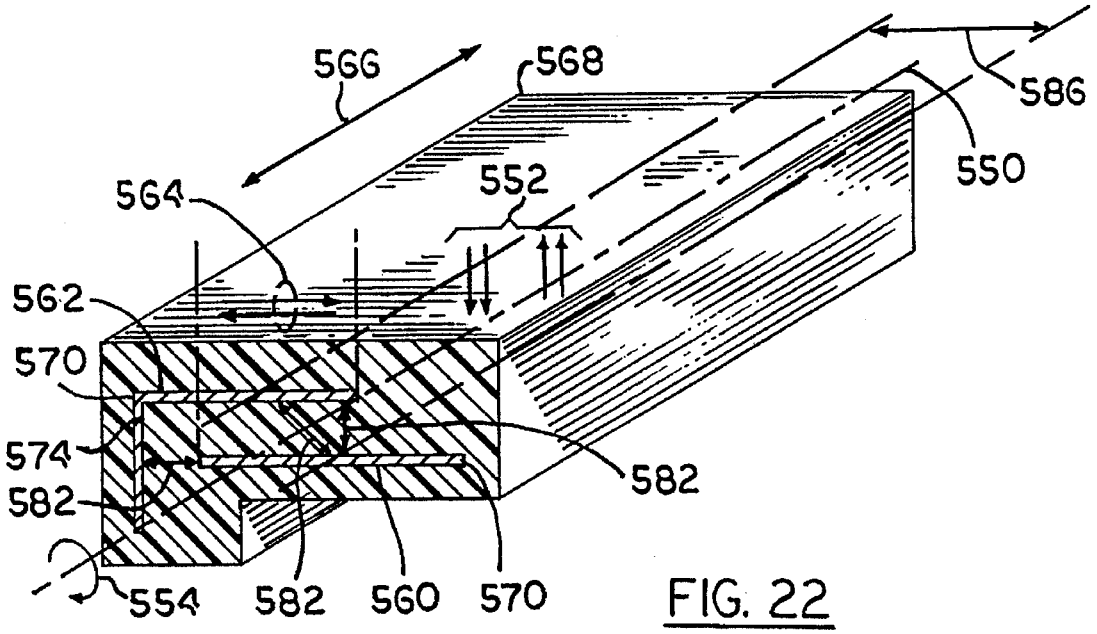
FIG. 22 is a perspective view of a structural frame member, of the invention.

In FIG. 22, resistance to shear 552, bending 554 or breaking about line 550 is prevented by wall 560 and wall 562 intersecting laterally 564 to length direction 566 of frame member 568. In addition the arrangement has the discontinuity in metal element 570 in that wall 560 is separate from and continuously spaced from walls 562 and 574 along the length of the frame member. Also, in FIG. 22, metal element 570 is discontinuous normal 582 to length direction 566 of frame member 568 and metal element 570. Also, wall 560 is generally parallel with the joined walls 562 and 574, as parallel strips 586.

Figure 23:
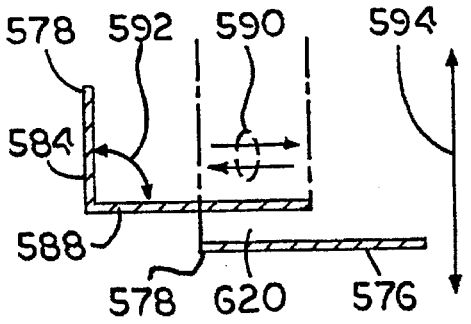
FIG. 23 is a schematic cross section end view of a discontinuous metal element for a frame member, of the invention.

In FIG. 23, in discontinuous metal element 578 the intersection laterally 590 to length direction 594 of walls 576 and 588 in the continuous space 620 between the walls that extends longitudinally with the walls, provides lateral strength. Wall 576 is separate from walls 588 and 584. Wall 584 is angled 592 from the plane of wall 588.

Figure 24:
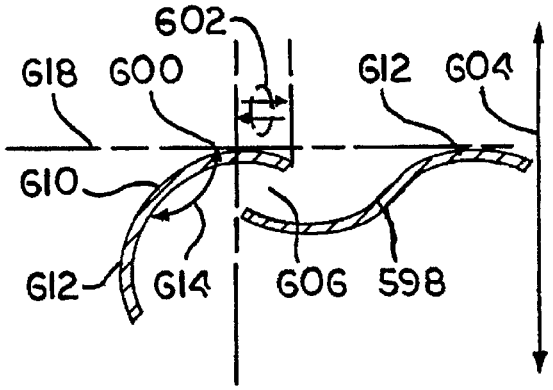
FIG. 24 is a schematic cross section end view of a discontinuous metal element for a frame member, of the invention.

In FIG. 24, the intersection laterally 602 to length direction 604, of walls 598 and 600 in the space 606 that extends continuously the length of metal element 612 between wall 598 and walls 600 and 610, provides lateral strength. Wall 610 is continuously joined with wall 600 along the length of metal element 612, and is angled 614 from tangent line 618 of wall 600. Wall 598 is separate from walls 610 and 600.

Figure 25:
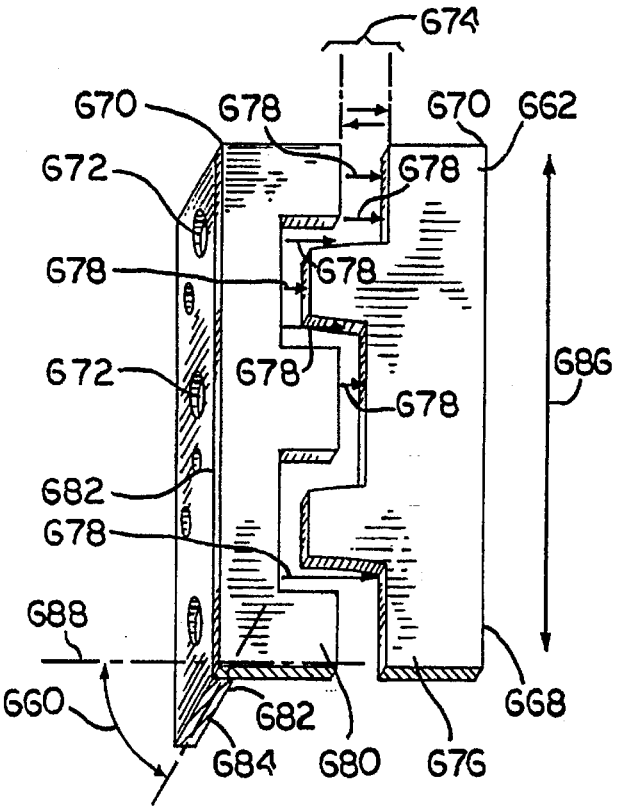
FIG. 25 is a perspective view of a discontinuous metal element for a structural frame member of the invention.

In FIG. 25, metal element 670 has wall 676 intersecting wall 680 of joined walls 680 and 684, laterally 674 to length direction 686. This provides improved lateral strength.

Metal element 670 is discontinuous normal to the length as shown by arrows 678. Wall 680 is connected to side 682 of wall 684 in a continuous joining along the length of the first wall, and angled 660 from tangent 688 to wall 680. Wall 676 is separate from walls 680 and 684. Side 668 of wall 676 is parallel with side 682 of wall 684 substantially along the length of wall 684. Side 662 is also parallel with side 682 substantially along the length of wall 684. Wall 676 and wall 680 extend along length 686 like parallel strips, as do walls 676 and 684. Wall 684 includes a plurality of openings 672 through the wall, enclosed within the wall and exclusive of the adjacent wall, for receiving plastic through the openings.

Figure 26:
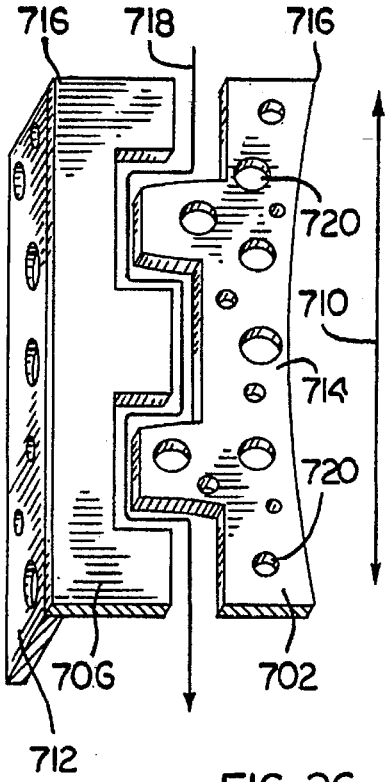
FIG. 26 is a perspective view of a discontinuous metal element for a structural frame member of the invention.

Referring to FIG. 26, wall 702 is continuously spaced from wall 706 along the length 710 of metal element 716, as shown by arrow 718 which travels through the space. Walls 702 and 706 are generally parallel along length 710, as parallel strips. Wall 702 is also generally parallel with joined walls 706 and 712, as parallel strips. Side 714 of wall 702 is slightly curved inward so that the structural frame member which comprises metal element 716 fits with a slightly bowed associate part of a window frame (not shown). Wall 702 includes a plurality of openings 720 through the wall, enclosed with the wall and exclusive of the adjacent wall, and of other walls in metal element 716, for receiving plastic through the openings.

Figure 27:
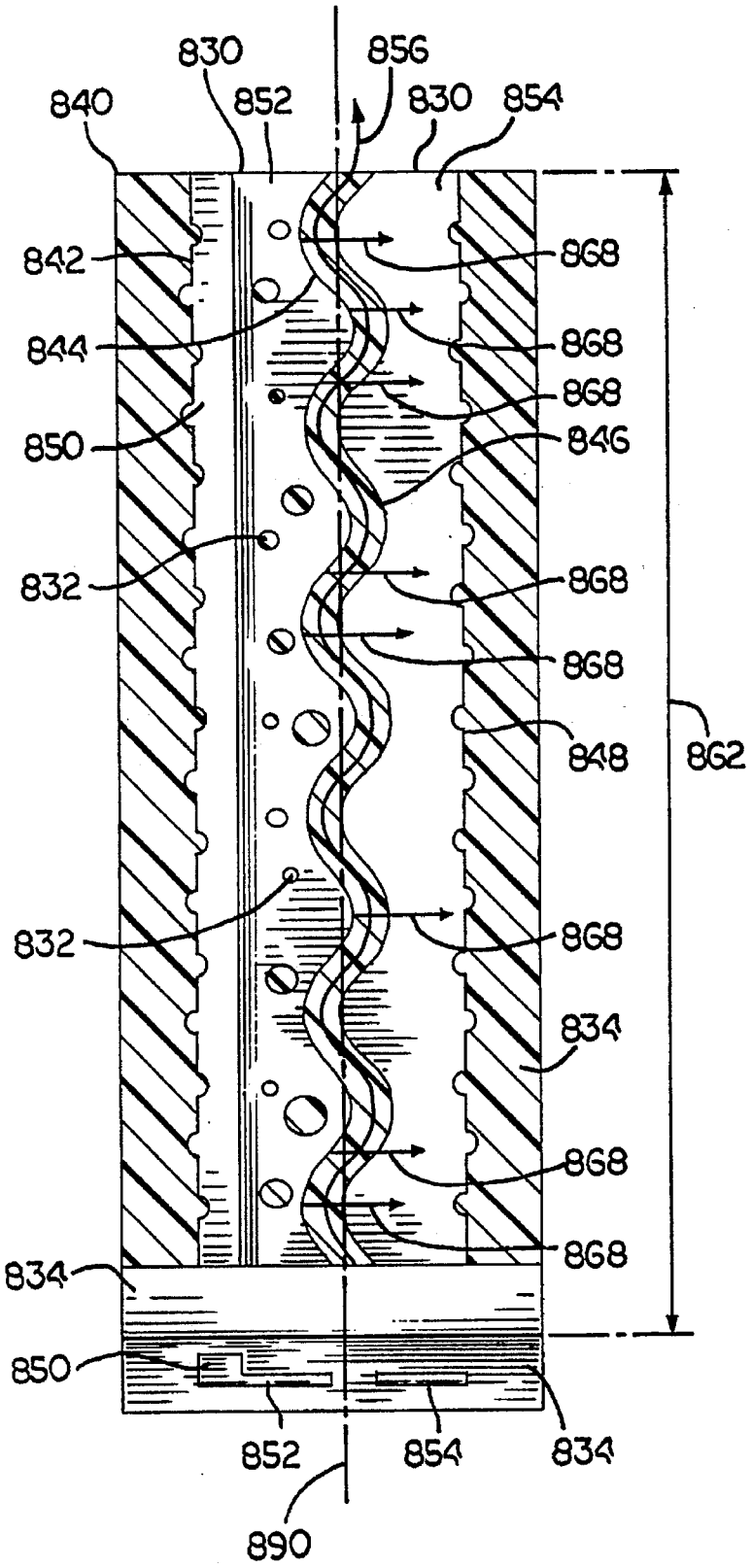
FIG. 27 is a perspective view taken from V34, of the structural frame member of FIG. 28 in which the plastic element is partially cut away to reveal the metal element.
Figure 28:
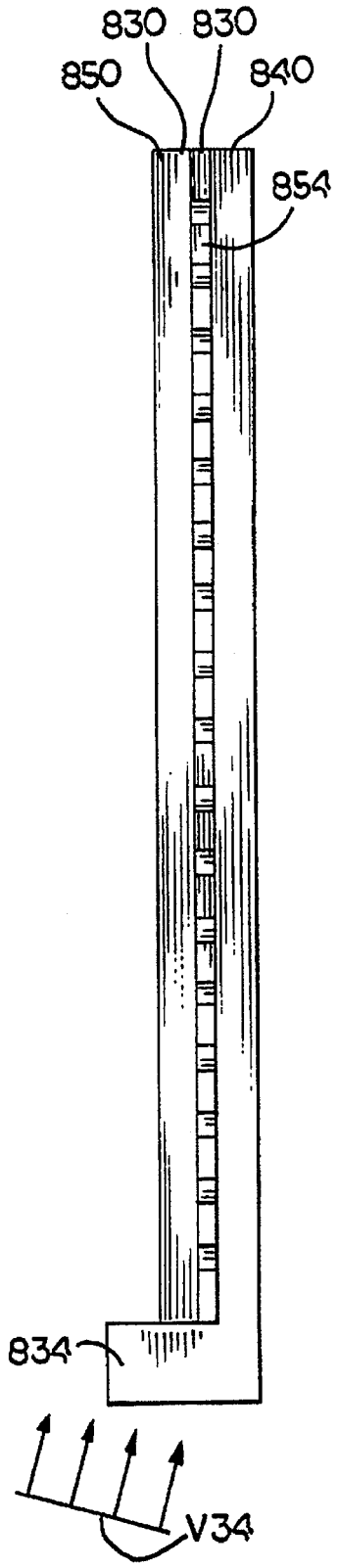
FIG. 28 is a side view of a structural frame member, with the plastic partially cut away.

Referring to FIGS. 27 and 28, structural frame member 840 provides a maximum of longitudinal and lateral strength.

Maximum grip between discontinuous metal element 830 and plastic element 834 of structural frame member 840 is provided by serpentine edges 842, 844, 846 and 848 of continuously spaced, generally parallel walls 852 and 854, and wall 850, wherein the serpentine edges supplement the grip provided by openings 832, and plastic element 834 encloses metal element 830 on essentially on all surfaces along its length in a composite, unitary molding with metal element 830.

Good resistance to shear, bending or breaking about line 890 is provided by the crossing over of line 890 by walls 852 and 854 as they intersect laterally to the length of metal element 830.

Lateral thermal flow is minimized by continuous space 856 between separate walls 852 and 854 of discontinuous metal element 830, which is discontinuous normal to length 862 of metal element 830, as shown by arrows 868.

When the second element material such as vinyl is extruded over the first element it is likely that depressions are formed on the surface of the frame member over the openings in the second element unless the openings are very small. It is believed that this is due to the restriction in rate of flow of plastic into and through the opening caused by the size of the opening and access to the opening by the flowing plastic.

Figure 29:
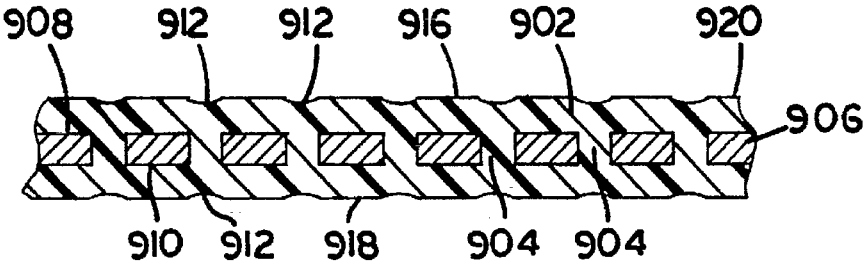
FIG. 29 is a cross section view of a portion of a frame member.
Figure 30:
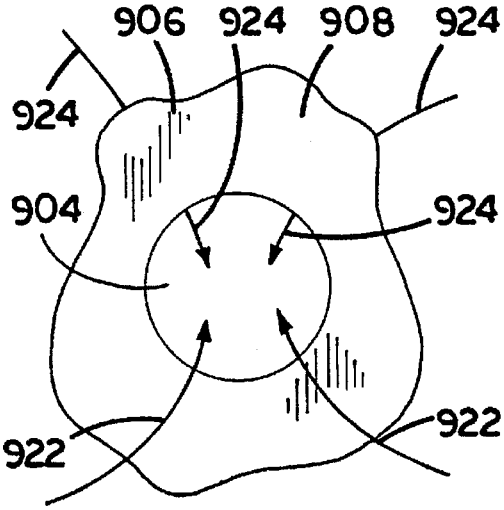
FIG. 30 is a front view of a wall of a metal element for a frame member of the invention.
Figure 31:
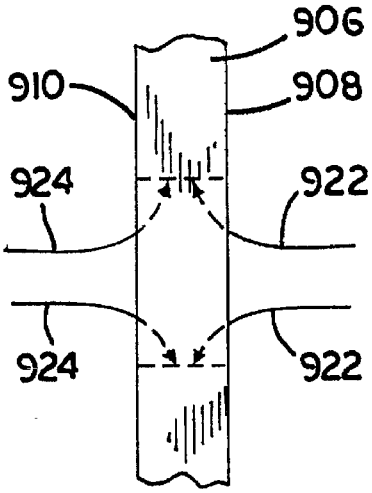
FIG. 31 is a side view of a wall of a metal element for a frame member of the invention.

In FIGS. 29–31, second element 902 enters openings 904 of first element 906 by entering 922 through the plane of front face 908 and entering 924 through the plane of back face 910 of first element 906. This results in depressions 912 on front face 916 and back face 918 of frame member 920.

This telegraphing of the openings by the surface of the frame member can be reduced by filling the opening through three entrances instead of two entrances, preferably with the entrances being in different faces of the wall containing the openings, the faces being in different sides of the wall, in different planes.

Preferably the openings include an edge of the wall in which they reside. This continues to provide structural integrity between the first metal element and the second plastic element, yet provides a smoother finish on the structural frame member by eliminating dents in the surface that would telegraph presence of openings enclosed within the wall.

Figure 32:
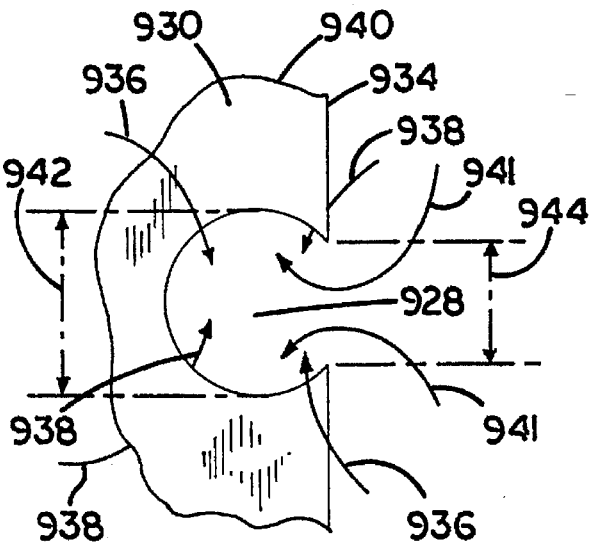
FIG. 32 is a front view of a wall of a metal element for a frame member of the invention.
Figure 33:
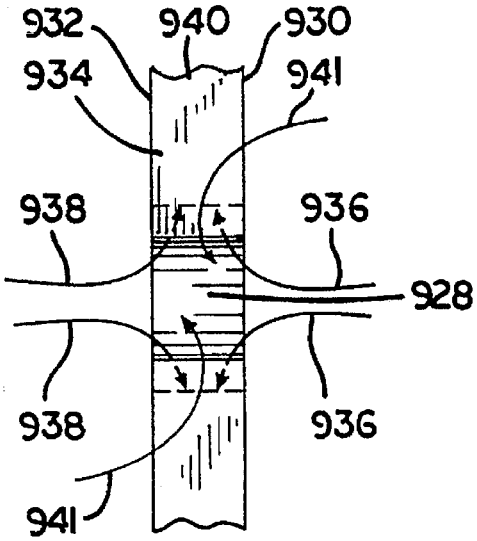
FIG. 33 is a side view of a wall of a metal element for a frame member of the invention.

In FIGS. 32 and 33, opening 928 in metal first element wall 940 is in front 930, back 932, and included side 934 between the front and back. The second element which is plastic, enters the opening, entering 936 through the plane of front 930, entering 938 through the plane of back 932, and entering 941 through the plane of included side 934. Thus the recess in the included side by opening 928 is filled by the second element.

Opening 928 is larger size 942 on front 930 and on back 932 than size 944 on included side 934. The second element, thus entering opening 928, is molded to itself through the front, back and included side.

Figure 34:
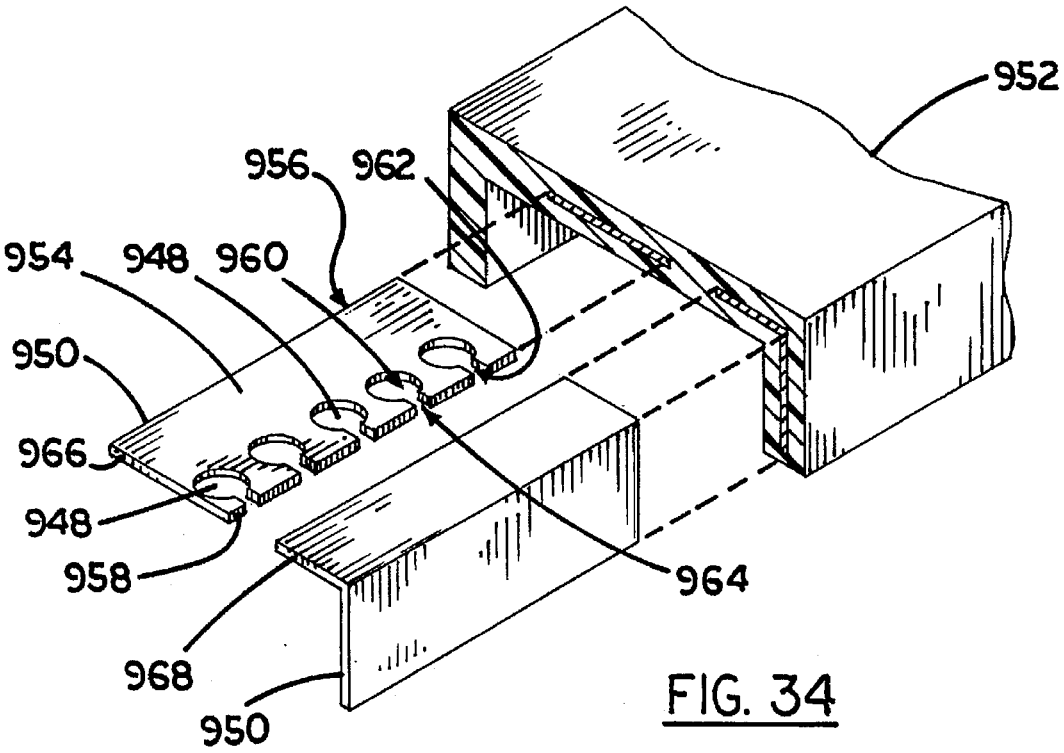
FIG. 34 is a perspective view of a structural frame member of the invention.

In FIG. 34, openings 948 in metal first element 950 of frame member 952, each include front 954, back 956, and included side 958. Plastic second element enters 960 openings 948 during extrusion of the frame member, by way 960 of the front, 962 of the back, and 964 of the included side.

Each opening 948 is larger on the front than on the included side, and the openings in wall of first element 950 are exclusive of adjacent wall 968 of the first element.

Figure 35:
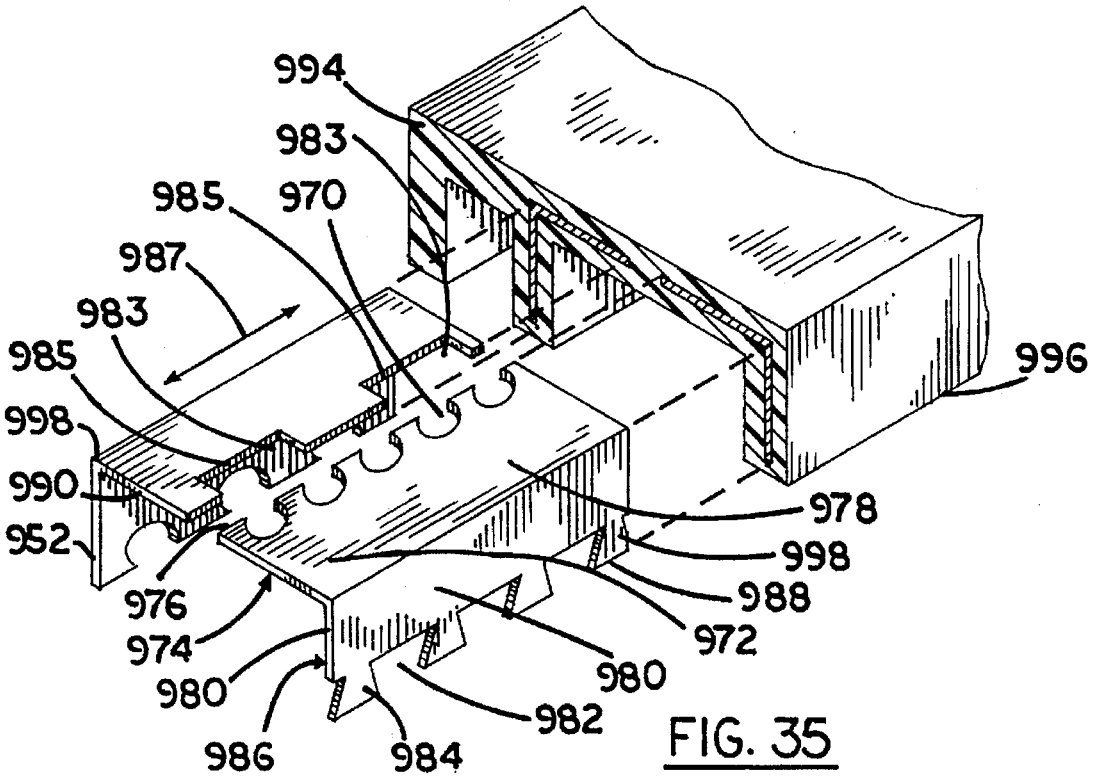
FIG. 35 is a perspective view of a structural frame member of the invention.

In FIG. 35, openings 970 in wall 978 of metal first element 998 are larger on front 972 and back 974 than on included side 976, and are exclusive of adjacent wall 980. The recesses formed by openings 970 along the included side form a serpentine surface on the included side.

Openings 982 in wall 980 are larger on front 984 and back 986 than on included side 988, form a serpentine surface on included side 988, and are exclusive of adjacent walls 978, 990 and 992.

When extruded with plastic second element 994 of structural frame member 996, the plastic molds to itself through the front face, back face and included side of each of the walls containing the openings.

Openings 983 are rectangular, the longer walls 985 of the rectangles extend lengthwise 987 with first wall 990 and first element 998.

Figure 36:
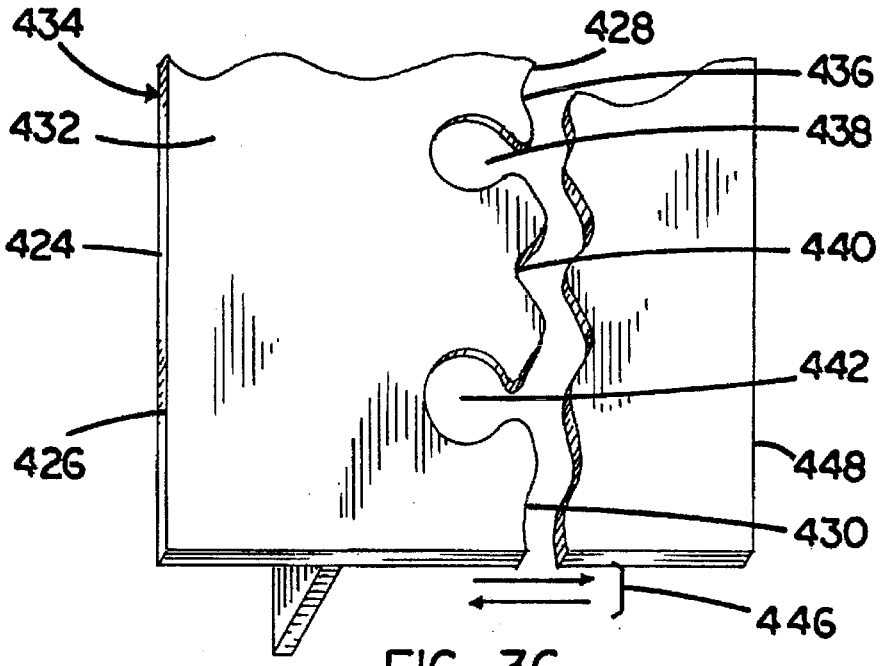
FIG. 36 is a perspective view of a discontinuous metal element for a structural frame member of the invention.
Figure 37:
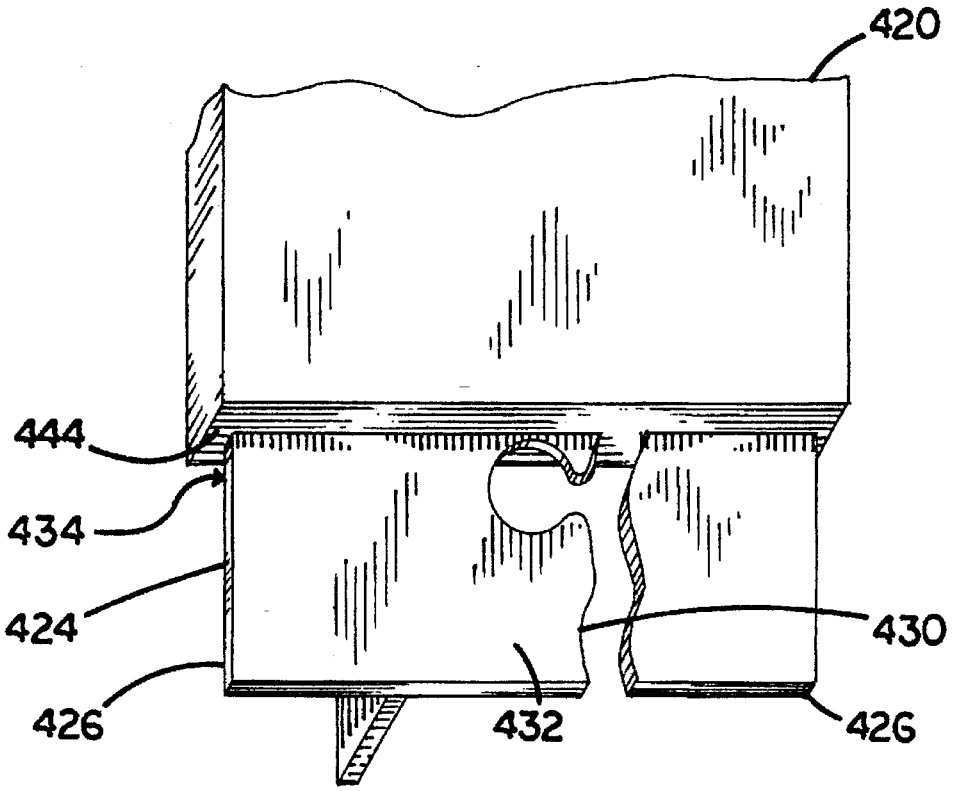
FIG. 37 is a perspective view of a structural frame member of the invention, including the metal element of FIG. 36.

In FIGS. 36 and 37, structural frame member 420 includes wall 424 of metal first element 426. Serpentine surface 428 of included wall 430 of front 432 and back 434 of wall 424 comprises recesses 436, 438, 440, and 442 in the surface of wall 430. The recesses form openings in the front and back so that plastic second element 444 is molded to itself through the front, back and included wall in each opening. Wall 424 of first element 426 intersects laterally 446 with wall 448 of first element 426.

Figure 38:
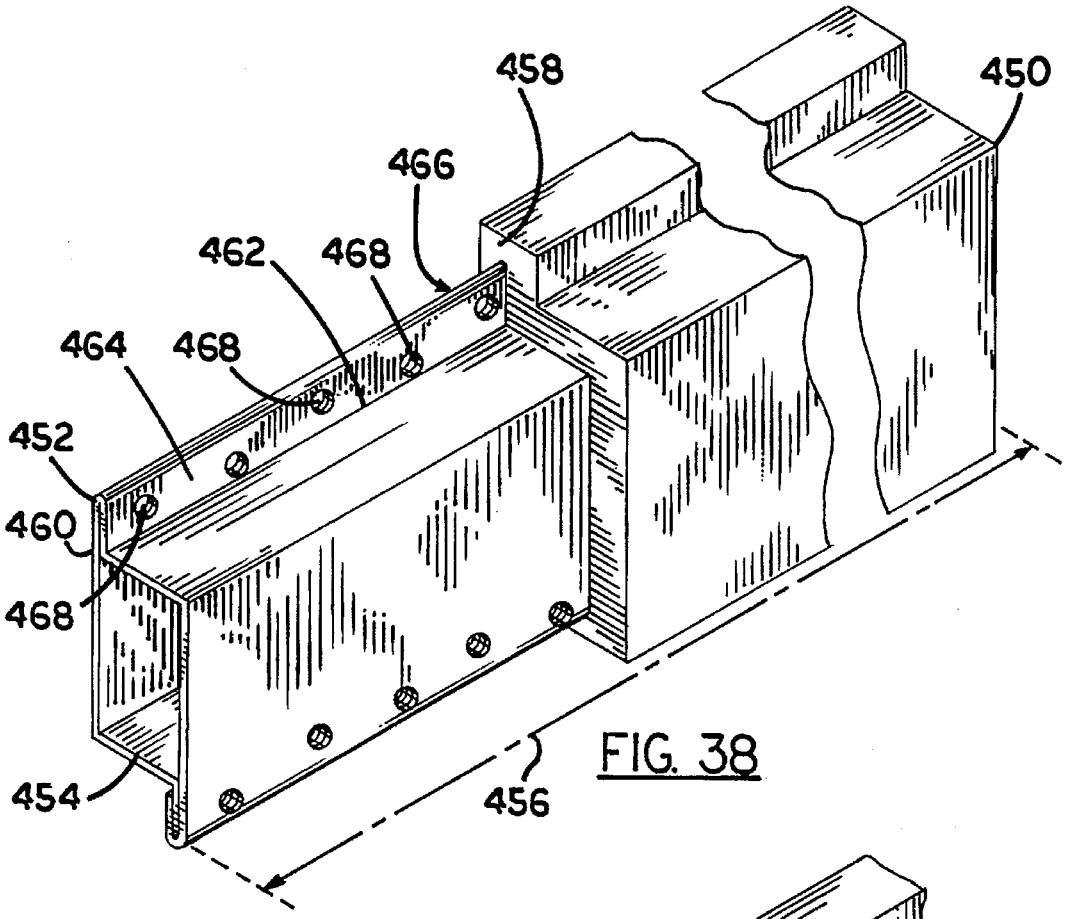
FIG. 38 is a perspective view of a tubular metal element for a structural frame member of the invention.

In FIG. 38, structural frame member 450 includes metal first element 452 which includes tube 454 substantially the length 456 of first element 452. Tube 454 is inflexible and structural in nature for contributing structural strength to the frame member.

Second element 458 is plastic and inflexible, structurally strong independently of the first element, comprises the shape of the frame member and encloses the first element on essentially all outer surfaces of the first element along its length in a composite, unitary molding with the first element. A portion of the plastic element is removed to better show the metal element.

Wall 460 attached to the tube by side 462 of the wall, extends from the tube the length of the first element. Second element 458 is molded to itself from front 464 to back 466 of wall 460 through openings 468 which are enclosed in wall 460.

Figure 39:
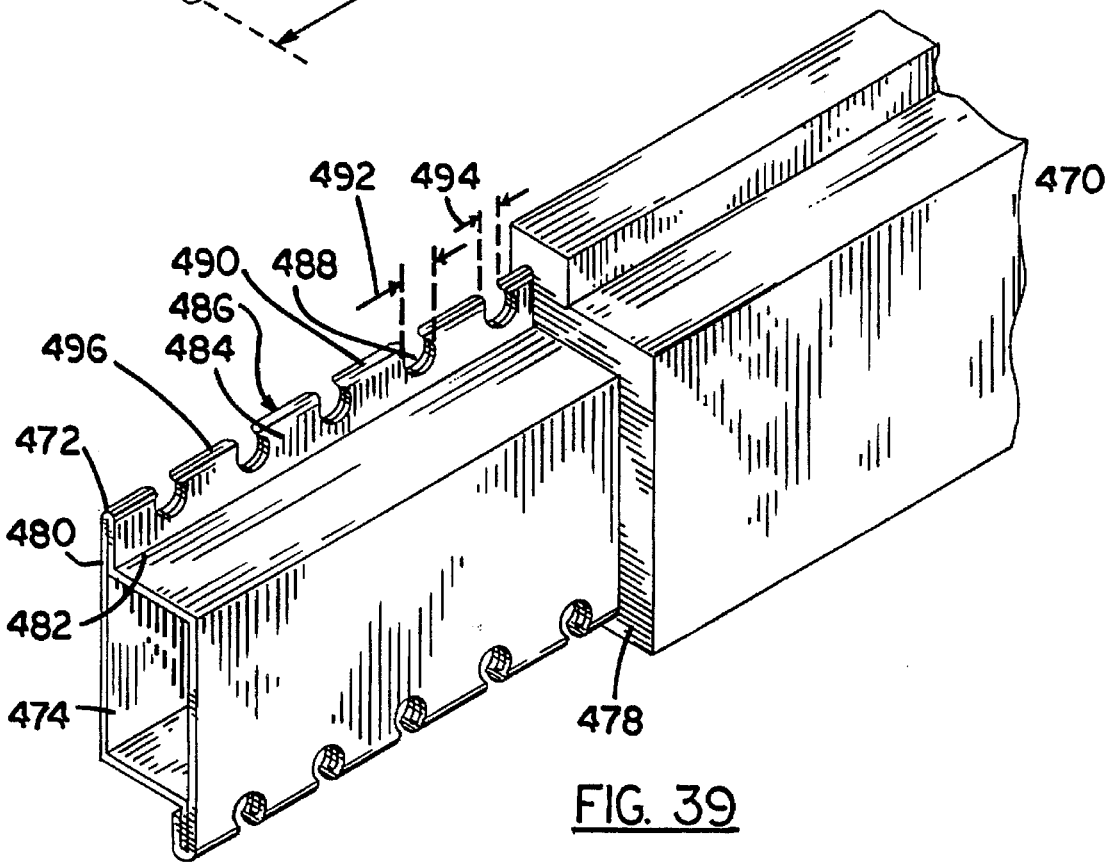
FIG. 39 is a perspective view of a structural frame member of the invention.

In FIG. 39, structural frame member 470 includes metal first element 472 which includes tube 474 substantially the length of first element 472. Tube 474 is inflexible and structural in nature for contributing structural strength to the frame member.

Second element 478 is plastic and inflexible. A portion is removed to better show the metal element.

Wall 480 attached to the tube by side 482 of the wall extends from the tube the length of the first element.

Second element 478 is molded to itself from front 484 to back 486 of wall 480 through openings 488 which extend through included side 490 of wall 480. The plastic is molded to itself through the included side with the openings.

The openings are larger in size 492 on front 484 than in size 494 on side 490.

The series of recesses on side 490 comprised by openings 488 forms serpentine surface 496 on wall 480.

Figure 40:
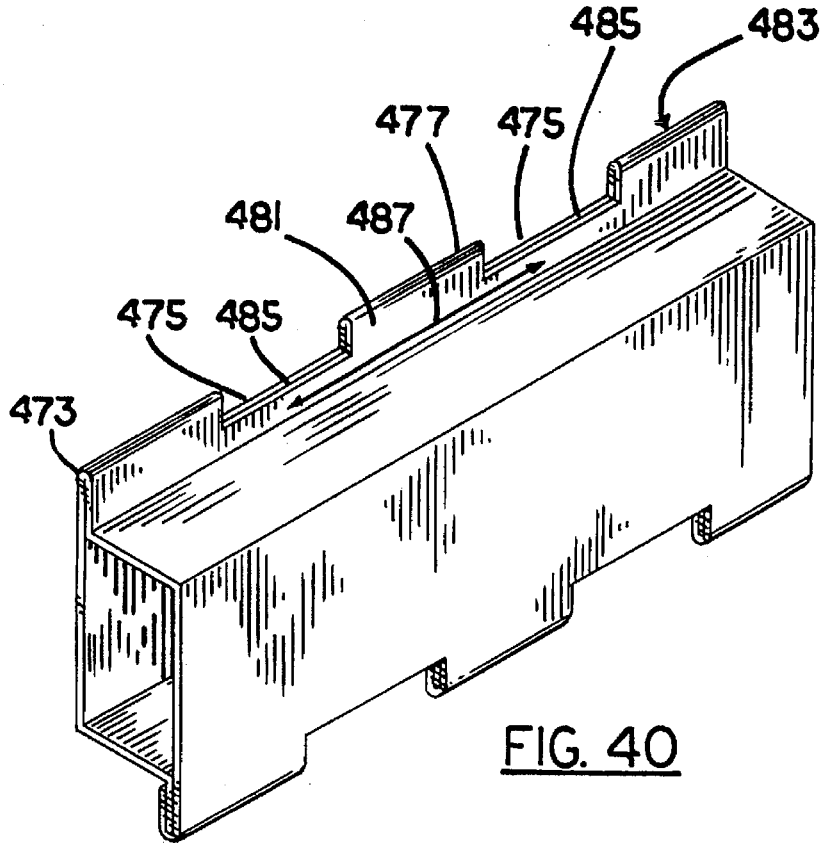
FIG. 40 is a perspective view of a tubular metal element for a structural frame member of the invention.
Figure 41:
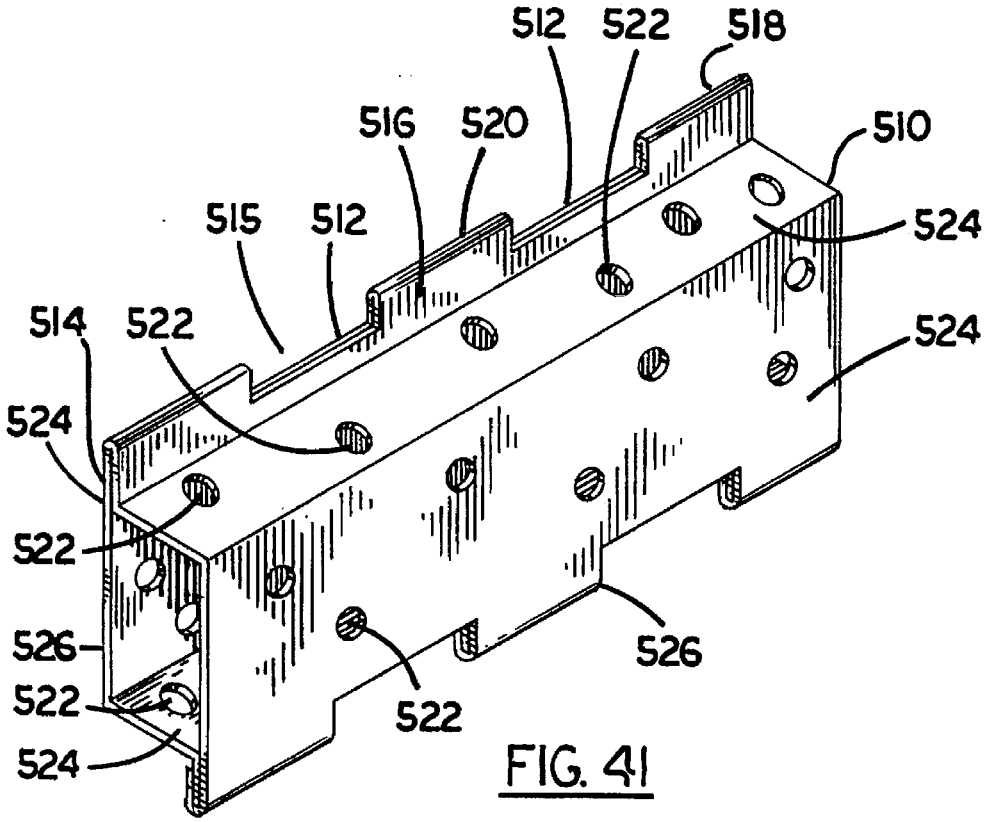
FIG. 41 is a perspective view of a tubular metal element for a structural frame member of the invention.

In FIG. 40, metal first element 473 has rectangular recesses 475 on included wall 477 of walls 481 and 483. Longer sides 485 of the rectangles extend lengthwise 487 with wall 481.

In FIGS. 41–44, metal first element 510 has recesses 512 forming openings 515 in wall 514 comprising sides 516, 518 and their included side 520. First element 510 also has openings 522 through side 524 of tube 526.

Figure 42:
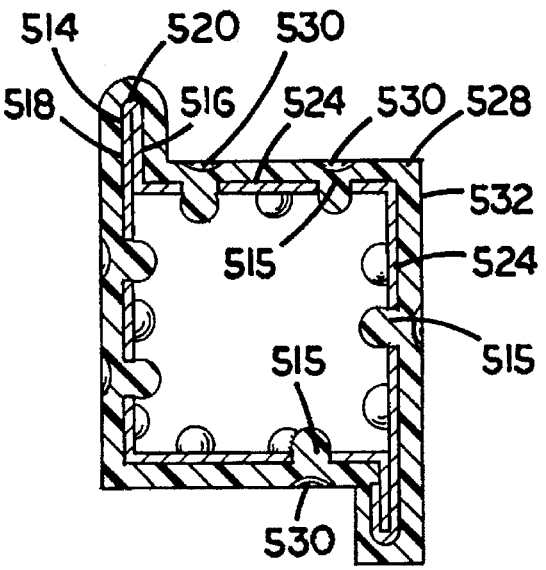
FIG. 42 is a cross section view of a structural frame member of the invention, including the metal element of FIG. 41.
Figure 43:
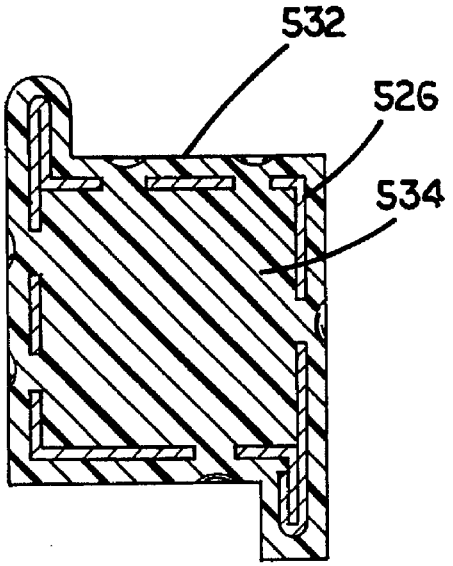
FIG. 43 is a cross section view of a structural frame member of the invention, including the metal element of FIG. 41.
Figure 44:
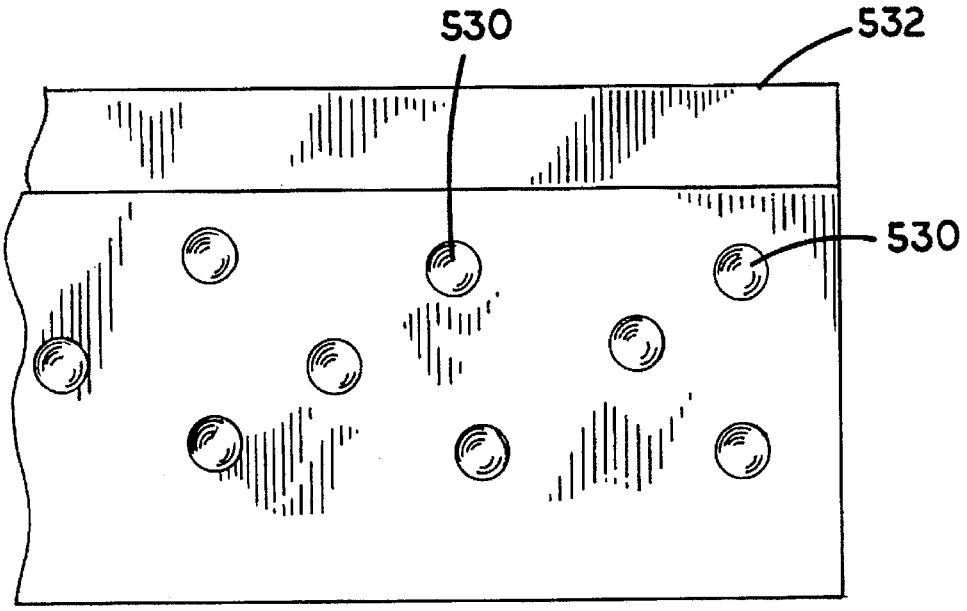
FIG. 44 is a top view of the structural frame member of FIG. 42.

Plastic second element 528 is molded to itself through openings 515 and, in FIG. 42 extends through side 524 by way of openings 515. This leaves depressions 530 on the surface of structural frame member 532.

The extent of the depressions may be reduced by filling the tube 526 with plastic 534.

Figure 45:
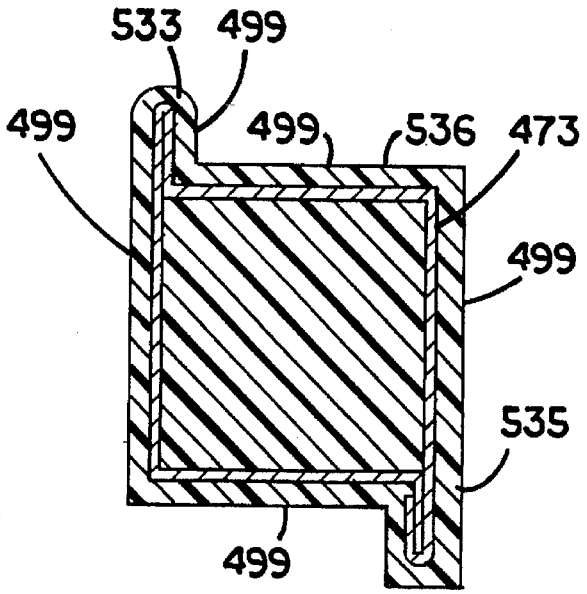
FIG. 45 is a cross section view of a structural frame member of the invention, including the metal element of FIG. 40.
Figure 46:
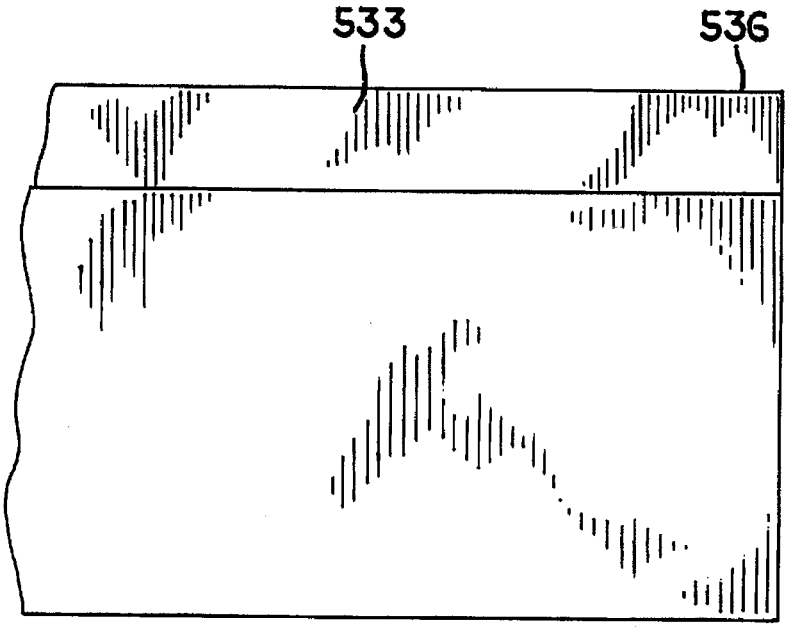
FIG. 46 is a top view of the structural frame member of FIG. 45.

In FIGS. 45 and 46, structural frame member 536 has metal first element 473 of FIG. 40 which does not have openings in the sides of the tube, and has openings formed by rectangular recesses 475 filled by plastic second element 535 from three planes of walls 481, 483, and their included wall 477. This provides a smooth outer surface 499 of the tube and extending wall 533 of structural frame member 536, free of depressions.

It is to be understood that the tube is not limited to square in cross section, but may be any shape in cross section including circular, and that the depressions may be other shapes including square, and are not limited to having three sides as in the rectangle.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

I claim:

1. In an improved inflexible substantially straight, structural frame member of predetermined shape, for windows and doors, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a second side, a front and a back, and said second wall having a first side, a front and a back, said second wall being connected on its first side to the first side of said first wall in a substantially continuous joining, substantially along the length of said first wall, and angled from said first wall, a first plurality of openings through said first wall exclusive of said second wall, said second element being molded to itself from the front to the back of said first wall through said first plurality of openings, the improvement comprising said first element further being discontinuous in that it comprises a third wall being essentially separate from said first and second walls, and being generally parallel with said first and second walls substantially along the length of said first wall, as parallel strips.

2. The frame member of claim 1, further comprising:

said first plurality of openings comprising said second side, said second element being molded to itself through said second side with said first plurality of openings.

3. The frame member of claim 2, further comprising:

said first plurality of openings being larger on one of the front and back of said first wall than on the second side of said first wall.

4. The frame member of claim 2 further comprising:

said first plurality of openings comprising recesses in said first wall.

5. The frame member of claim 4, further comprising:

said recesses in said first wall comprising a serpentine surface on said first wall.

6. The frame member of claim 2, further comprising:

said third wall and one of said first and second walls intersecting laterally.

7. In an improved inflexible substantially straight, structural frame member of predetermined shape, for windows and doors, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a front and a back, and said second wall having a first side, a front and a back, said second wall being connected on its first side to the first side of said first wall in a substantially continuous joining, substantially along the length of said first wall, and angled from said first wall, a first plurality of openings through a wall of said first element, said second element being molded to itself from the front to the back of the wall containing said first plurality of openings, through said first plurality of openings, the improvement comprising said first element further being discontinuous in that it comprises a third wall being essentially separate from said first and second walls, and being generally parallel with said first and second walls substantially along the length of said first wall, as parallel strips.

8. The frame member of claim 7, further comprising:

said first plurality of openings comprising an included side between the front and back of said wall containing said first plurality of openings, said second element being molded to itself through said included side with said first plurality of openings.

9. The frame member of claim 8, further comprising:

said first plurality of openings being larger on one of the front and back of said first wall, than on said included side.

10. The frame member of claim 8, further comprising:

said first plurality of openings comprising recesses in said included side.

11. The frame member of claim 10, further comprising:

said recesses in said included side comprising a serpentine surface of said included side.

12. The frame member of claim 10, further comprising:

said recesses in said included side being generally rectangular, the longer walls of the rectangles extending lengthwise with said first wall.

13. The frame member of claim 7, further comprising:

said third wall and one of said first and second walls intersecting laterally.

14. In an improved inflexible substantially straight, structural frame member of predetermined shape, for windows, and doors, said frame member comprising:

a first elongated element having a length, at least one surface, and being substantially non-hollow in transverse cross section, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all surfaces along its length in a composite, unitary molding with said first element, said first element comprising a first wall substantially the length of said first element, and a second wall, said first wall having a first side, a front and a back, and said second wall having a first side, a front and a back, said second wall being connected on its first side to the first side of said first wall in a substantially continuous joining, substantially along the length of said first wall, and angled from said first wall, a first plurality of openings through a wall of said first element exclusive of adjacent walls of said first element, said second element being molded to itself from the front to the back of the wall containing said first plurality of openings, through said first plurality of openings, the improvement comprising said first element further being discontinuous in that it comprises a third wall being essentially separate from said first and second walls, and being generally parallel with said first and second walls substantially along the length of said first wall, as parallel strips.

15. The frame member of claim 14, further comprising:

said first plurality of openings comprising an included side between the front and back of said wall containing said first plurality of openings, second element being molded to itself through said included side with said first plurality of openings.

16. The frame member of claim 15, further comprising:

said first plurality of openings being larger on one of the front and back of said first wall, than on said included side.

17. The frame member of claim 15, further comprising:

said first plurality of openings comprising recesses in said included side.

18. The frame member of claim 17, further comprising:

said recesses in said included side comprising a serpentine surface of said included side.

19. The frame member of claim 15, further comprising:

said recesses in said included side being generally rectangular, the longer walls of the rectangles extending lengthwise with said first wall.

20. The frame member of claim 14, further comprising:

said third wall and one of said first and second walls intersecting laterally.

21. An inflexible frame member of predetermined shape, for windows and doors, said frame member comprising:

a first element having a length, at least one surface, and comprising a tube substantially the length of said first element and having a side, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all outer surfaces of the first element along its length in a composite, unitary molding with said first element, a first wall having a front, a back, a first side and a second side, said first wall being attached on said first side to said tube extending from said tube substantially the length of said first element, a first plurality of openings through said first wall, said second element being molded to itself from the front to the back of said first wall through said first plurality of openings.

22. The frame member of claim 21, further comprising:

said first plurality of openings through said first wall being enclosed within said first wall.

23. The frame member of claim 21, further comprising:

said first plurality of openings comprising said second side, said second element being molded to itself through said second side with said first plurality of openings.

24. The frame member of claim 23, further comprising:

said first plurality of openings being larger on one of the front and back of said first wall than on the second side of said first wall.

25. The frame member of claim 23 further comprising:

said first plurality of openings comprising recesses in said first wall.

26. The frame member of claim 25, further comprising:

said recesses in said first wall comprising a serpentine surface on said first wall.

27. The frame member of claim 25, further comprising:

said recesses in said first wall being generally rectangular, the longer walls of the rectangles extending lengthwise with said first wall.

28. The frame member of claim 21, further comprising:

a second plurality of openings through the side of said tube, said second element extending into said second plurality of openings.

29. The frame member of claim 28, further comprising:

said second element being molded to itself through said second plurality of openings.

30. The frame member of claim 29, further comprising:

said tube being filled with plastic substantially the length of said first element.

31. An inflexible frame member of predetermined shape, for windows and doors, said frame member comprising:

a first element having a length, at least one surface, and comprising a tube substantially the length of said first element and having a side, said first element being a metal, and being inflexible and structural in nature, for contributing structural strength to said frame member, a second element, said second element being a plastic, and being inflexible, structurally strong independently of said first element, comprising the shape of the frame member, and enclosing said first element on essentially all outer surfaces of the first element along its length in a composite, unitary molding with said first element, a first wall having a front, a back, a first side and a second side, said first wall being attached on said first side to said tube extending from said tube substantially the length of said first element, a first plurality of openings through the side of said tube, said second element being molded through said first plurality of openings.

32. The frame member of 31, further comprising:

said second element being molded to itself through said first plurality of openings.

33. The frame member of claim 31, further comprising:

said tube being filled with plastic substantially the length of said first element.

34. The frame member of claim 33, further comprising:

the plastic substantially filling said tube comprising said second element.

* * * * *